US008389844B2

(12) United States Patent
Tsuchiya et al.

(10) Patent No.: US 8,389,844 B2
(45) Date of Patent: Mar. 5, 2013

(54) TONE GENERATION APPARATUS

(75) Inventors: Hiroyuki Tsuchiya, Hamamatsu (JP); Kazuyuki Ito, Hamamatsu (JP); Masahiko Hasebe, Hamamatsu (JP); Kouichi Kashiwazaki, Hamamatsu (JP); Hiroyuki Iwase, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 27 days.

(21) Appl. No.: 13/196,741

(22) Filed: Aug. 2, 2011

(65) Prior Publication Data

US 2012/0031256 A1 Feb. 9, 2012

(30) Foreign Application Priority Data

Aug. 3, 2010 (JP) ..... 2010-174517
Aug. 3, 2010 (JP) ..... 2010-174518
Aug. 3, 2010 (JP) ..... 2010-174519

(51) Int. Cl.
*G10H 7/00* (2006.01)

(52) U.S. Cl. ..... 84/604; 84/609; 84/622; 84/625; 84/626

(58) Field of Classification Search ..... None
See application file for complete search history.

(56) References Cited

U.S. PATENT DOCUMENTS 5,136,916 A * 8/1992 Shibukawa ..... 84/627
5,177,314 A * 1/1993 Matsuda et al. ..... 84/615
5,221,804 A 6/1993 Shibukawa
5,290,965 A 3/1994 Yoshida et al.
5,406,022 A * 4/1995 Kobayashi ..... 84/622
5,446,237 A 8/1995 Abe et al.
5,521,330 A * 5/1996 Kuwano ..... 84/662
6,169,241 B1 1/2001 Shimizu
7,790,977 B2 * 9/2010 Sato ..... 84/625
2001/0037196 A1 * 11/2001 Iwamoto ..... 704/207
2012/0031256 A1 * 2/2012 Tsuchiya et al. ..... 84/604
2012/0230495 A1 * 9/2012 Murali et al. ..... 381/3

FOREIGN PATENT DOCUMENTS

JP 2-671690 B2 7/1997
JP 2-915452 B2 4/1999
JP 3-666346 B2 4/2005

OTHER PUBLICATIONS

Anonymous. (Jul. 31, 2010). "E-mu Emulator," Wikipedia, located at http://en.wikipedia.org/w/index.php?title=E-mu_Emulator&oldid=376370538, last visited Sep. 19, 2011, two pages.
European Search Report mailed Oct. 4, 2011, for EP Patent Application No. 11176241.5, nine pages.

* cited by examiner

*Primary Examiner* — Marlo Fletcher
(74) *Attorney, Agent, or Firm* — Morrison & Foerster LLP

(57) ABSTRACT

In response to detection of a note-on instruction, a CPU assigns a tone generating unit comprising two tone generating channels and sets tone color control data of the assigned tone generating unit into tone generator registers. The tone color control data includes a parameter common to the two channels. Once the CPU gives a tone generation start instruction to a tone generator, the tone generator accumulates a frequency number common to the two channels to thereby generate a progressive phase common to the two channels. Waveform readout section reads out left-channel and right-channel waveform data from a waveform memory on the basis of the phase and waveform selecting information of the left and right channels. Tone characteristics of the read-out left- and right-channel waveform data are controlled by a characteristic control section on the basis of a characteristic control parameter common to the two channels.

8 Claims, 6 Drawing Sheets

TONE-GENERATING-UNIT-SPECIFIC DATA (128)

| | |
|---|---|
| PS (CENT) | |
| LFO FREQUENCY | PM DEPTH |
| FM DEPTH | AM DEPTH |
| PEG RATE | PEG LEVEL |
| FEG RATE | FEG LEVEL |
| AEG RATE | AEG LEVEL |
| PAN (L) | PAN (R) |
| Mode | OTHER PARAMETERS |

FIG. 3A

TONE-GENERATING-CHANNEL-SPECIFIC DATA (256)

| |
|---|
| START ADDRESS (WS) |
| LOOP START ADDRESS (LS) |
| END ADDRESS (WE) |
| CONPRESSION INFO. |
| OTHER PARAMETERS |

FIG. 3B

WAVEFORM DATA

| |
|---|
| WD1m |
| WD2sl |
| WD2sr |
| WD3sl |
| WD3sr |
| ⋮ |

FIG. 4

TONE GENERATION APPARATUS

BACKGROUND

The present invention relates to a tone generation apparatus capable of efficiently generating tones even where the number of tone generating channels is increased.

Among the conventionally-known tone generation apparatus are ones which include: a performance information input section that receives performance information from any of a MIDI (Musical Instrument Digital Interface), keyboard, sequencer, etc.; a control section (CPU) that generates tone generator parameters for use in tone generation; and a tone generator section that generates tones on the basis of the tone generator parameters. In response to input performance information, the control section (CPU) performs control processing, such as channel assignment and generation of tone generator parameters, and supplies a tone generation start instruction and tone parameters to the tone generator section. The tone generator section includes a tone generator register for storing therein tone parameters for use in tone generation, and a tone generation processing section that performs tone generation processing. The tone parameters supplied from the control section (CPU) are stored into the tone generator register, and the tone generation processing section performs the tone generation processing on the basis of the tone parameters stored in the tone generator register. By the tone generation processing being performed on the basis of the tone parameters stored in the tone generator register like this, a tone is generated as instructed by the control section (CPU). As the tone generator section, there has heretofore been known a waveform-memory type tone generator that includes a waveform memory having actual tone waveforms recorded therein as waveform data. Different waveform data (more specifically, different waveform data set) is stored for each of various tone colors and for each of various pitch ranges in such a waveform-memory type tone generator, and the tone generation processing section reads out waveform data corresponding to a tone color and tone pitch of a tone to be generated and then characteristics of the read-out waveform data are controlled by use of control waveforms, such as a tone volume control envelope, generated on the basis of the tone generator parameters. Further, in order to simultaneously generate a plurality of tones, a plurality of tone generating channels are formed in the tone generation processing section, and the tone generation processing is performed time-divisionally in the individual tone generating channels. Thus, per sampling period, tone waveform samples are arithmetically generated in the plurality of tone generating channels, so that tones corresponding in number to the tone generating channels are generated.

Once a new tone generation command (i.e., note-on event) is generated, an empty tone generating channel is detected and assigned to the tone generation, and a tone is generated in the assigned tone generating channel. Note that the empty tone generating channel means a free channel which is not assigned to generate any tone currently. In such a case, if the tone generation processing is currently being performed in all of the tone generating channels, i.e. if all of the tone generating channels are currently assigned to tone generation, one of the tone generating channels which would present the least influence even if the tone generation in that channel is stopped on the way is selected. Then, so-called truncate processing is performed on the selected tone generating channel, in which the tone volume of the tone being generated in the selected tone generating channel is attenuated (or dumped) rapidly and the selected tone generating channel is released for new tone generation. Further, it has been a common practice in the art to select, as the channel where the truncate processing is to be performed (i.e., truncate channel), the channel where the tone currently being generated therein is the smallest in volume among all of the tone generating channels.

Generally, in such tone generation apparatus, an output section is of a stereo construction, and, in order to generate a high-quality tone, stereo waveform data are prestored in the waveform memory so that stereo waveform data corresponding to a tone to be generated is read out from the waveform memory to generate stereo tones.

In order to perform one stereo tone generation, i.e. for generation of left-channel and right-channel tones, it has been conventional for the known tone generation apparatus to use two tone generating channels. Namely, the control section (CPU) performs tone generation assignment processing for assigning two tone generating channels as the left and right channels to thereby secure or reserve the two tone generating channels. Further, because tone generator parameters for the individual tone generating channels (i.e., tone-generating-channel-specific tone generator parameters) are stored in the tone generator register, tone generator parameters for the left and right channels are stored in the tone generator register. The tone generation processing section reads out, on the basis of the tone-generating-channel-specific tone generator parameters, waveform data from the waveform memory at a rate corresponding to a designated tone pitch and then controls tone characteristics of the read-out waveform data by use of control waveforms, such as a tone volume control envelope. Namely, in the tone generating channel assigned as the left channel, left-channel waveform data is read out from the waveform memory and the tone characteristics of the read-out waveform data are controlled, on the basis of the tone generator parameters for the left channel, to generate tone waveform data of the left channel. Similarly, in the tone generating channel assigned as the right channel, right-channel waveform data is read out from the waveform memory and the tone characteristics of the read-out waveform data are controlled, on the basis of the tone generator parameters for the right channel, to generate tone waveform data of the right channel.

With the aforementioned conventionally-known tone generation apparatus, where two tone generating channels are required for generation of stereo tone waveform samples, there has been a need to increase the number of the tone generating channels, and there has been a tendency of increasing the number of tone generating channels capable of being handled by tone generating integrated circuitry (tone generator LSI). However, there is also encountered the problem that the increased number of tone generating channels in the tone generator section would lead to increased loads of various processing, such as tone generation assignment processing in which, in response to a tone generation instruction, a tone generating channel is assigned from among a multiplicity of tone generating channels that are objects of tone generator control processing performed by the control section (CPU), parameter setting processing for setting parameters of the multiplicity of tone generating channels into the tone generator register, etc. Also, the increased number of channels in the tone generator section would lead to an increased size or scale of the tone generating integrated circuitry. Furthermore, in order to control characteristics of the tone generating channels currently generating stereo tones in the tone generation processing section, control processing has to be performed for both of the left and right channels, and thus, the load on the tone generation processing section would increase. In such a case, although monaural tone generation requires controlling of characteristics of only one channel, the stereo tone generation requires simultaneous controlling of characteristics of the left and right channels within a same sampling period, because, otherwise, tones different in characteristic between the left channel and the right channel would be undesirably generated depending on the timing of tone generation, which would further increase the load on the tone generation processing section. Examples of such conventionally-known tone generation apparatus are disclosed in Japanese Patent Nos. 2671690, 3666346 and 2915452.

SUMMARY OF THE INVENTION

In view of the foregoing, it is an object of the present invention to provide an improved tone generation apparatus which can minimize an increase in loads of tone generation assignment processing, parameter setting processing, etc. even where the number of tone generating channels is increased.

It is another object of the present invention to provide an improved tone generation apparatus which can minimize an increase in the size of tone generating integrated circuitry even where the number of tone generating channels is increased.

In order to accomplish the above-mentioned objects, the present invention provides an improved tone generation apparatus, which comprises: a waveform memory (21) storing a plurality of stereo waveform data, each stereo waveform data comprising waveform data of a left-channel waveform and waveform data of a right-channel waveform; a tone generator (111, 112, 113, 116) which includes N (N is an integer equal to or greater than one) tone generating units (111, 112, 113, 116), each tone generating unit reads out waveform data for a left-channel and a right-channel from said waveform memory and generates tone waveforms of the left-channel and the right-channel based on the read-out waveform data; registers (23) storing control data for the N tone generating units, control data for each tone generating unit including left-channel waveform information specifying waveform data of a left-channel waveform in said waveform memory, right-channel waveform information specifying waveform data of a right-channel waveform in said waveform memory, a frequency number for controlling a tone pitch, and a characteristic control parameter for controlling a tone characteristic; and a controller (122, 10) which sets control data to said registers to control tone generation by said tone generator, wherein said controller (122, 10) being adapted to, in response to a tone generation command instructing generation of a new tone: (i) assign (S11-S15) one of the N tone generating units to generate the new tone instructed by the tone generation command; (ii) generate (S17) control data for the new tone including left-channel waveform information and right-channel waveform information, a frequency number and a characteristic control parameter which are to be used for the generation of the new tone, and set the generated tone control data into said registers, as control data for the assigned tone generating unit; and (iii) give (S18) to the assigned tone generating unit a tone generation start instruction, and wherein said tone generator (111, 112, 113, 116) being adapted to, by means of each one tone generating unit in response to the tone generation start instruction given to the one tone generating unit by said controller: (i) read out (111, 112) waveform data of a left-channel waveform and waveform data of a right-channel waveform, specified by the left-channel and right-channel waveform information, respectively, stored in said registers for the one tone generating unit, from said waveform memory at a rate corresponding to the frequency number stored in said registers for the one tone generating unit to thereby shift a tone pitch of the waveform data of the left-channel waveform and a tone pitch of the waveform data of the right-channel waveform in accordance with the frequency number; and (ii) control (113, 116) a tone characteristic of the read-out waveform data of the left-channel waveform and a tone characteristic of the read-out waveform data of the right-channel waveform on the basis of the characteristic control parameter, stored in said registers for the one tone generating unit, to thereby generate a tone waveform of the left channel and a tone waveform of the right channel.

According to the present invention, tone generation assignment processing assigns a tone generating unit, comprising two tone generating channels, to tone generation; namely, in the tone generation apparatus, the tone generation assignment processing is performed on the tone generating units that are half the number of the tone generating channels. Thus, the present invention can reduce the processing loads on the control section. Further, because the frequency number and the characteristic parameter are each common to the two tone generating channels of the tone generating unit, only one frequency number and only one characteristic parameter are to be set per tone generating unit, and thus, the present invention can significantly reduce a total time required for setting.

In one embodiment, the tone generator includes a phase generator which, for each of the N tone generating units, accumulates the frequency number stored in the registers for the tone generating unit, to thereby generate a progressive phase common to the left channel and the right channel in the tone generating unit. More specifically, in response the tone generation start instruction given to one tone generating unit by said controller, said phase generator starts accumulation of the frequency number for the one tone generating unit.

In one embodiment, the tone generator further includes a waveform reader (112, 20*c*, 20*d*, 20*f*) which, for each of the N tone generating units, reads out waveform data of a left-channel waveform from said waveform memory on the basis of the progressive phase for the tone generating unit supplied by said phase generator and the left-channel waveform information for the tone generating unit stored in said registers and reads out waveform data of a right-channel waveform from said waveform memory on the basis of the progressive phase for the tone generating unit and the right-channel waveform information for the tone generating unit stored in said registers.

In one embodiment, the tone generator further includes a characteristic controller (113, 116, 20*g*, 20*h*, 20*k*, 20*m*, 20*n*, 20*p*) which, for each of the N tone generating units, controls the tone characteristic of the waveform data of the left-channel waveform and the tone characteristic of the waveform of the right-channel waveform read out by said waveform reader, on the basis of the characteristic control parameter for the tone generating unit stored in said tone generator register, to thereby generate respective tone signals of the left channel and the right channel for the tone generating unit.

According to the present invention constructed in the aforementioned manner, the left-channel waveform data and the right-channel waveform data are read out from the waveform memory at a rate corresponding to the same or common F number and controlled in tone characteristic in accordance with the same or common characteristic control parameter, to thereby form a left-channel tone signal and right-channel tone signal having been controlled in tone pitch and tone characteristic similarly to each other. Further, because the left-channel tone signal and right-channel tone signal are formed on the basis of a phase signal common to the left and right channels, the number of progressive phases to be generated by the phase generation section is equal to the number of the tone generating units that is half the number of simultaneously generatable tones, i.e. half the number of the tone generating channels, and thus, an amount of processing by the phase generation section can be significantly reduced.

Further, the characteristic control parameter is a control waveform parameter, and because the control waveform generation section generates, for each of the tone generating units, a characteristic control waveform, common to both of the left channel and the right channel of the tone generating unit, on the basis of the control waveform parameter, the number of characteristic control waveforms to be generated by the control waveform generation section is equal to the number of the tone generating units that is half the number of simultaneously generatable tones, and thus, an amount of processing by the control waveform generation section can be significantly reduced. Note that the characteristic control waveform corresponds to any one of a pitch envelope waveform (pitch EG waveform), tone volume envelope waveform (tone volume EG waveform), filter envelope waveform (filter EG waveform) and low-frequency waveform (LFO waveform) described later in relation to an embodiment of the present invention.

With the aforementioned arrangements, the present invention can minimize an increase in a size or scale of tone generating integrated circuitry even where the number of the tone generating channels is increased.

According to another aspect of the present invention, there is provided an improved tone generation apparatus, which comprises: a waveform memory (21) storing a plurality of stereo waveform data, each stereo waveform data comprising waveform data of a left-channel waveform and waveform data of a right-channel waveform and a plurality of monaural waveform data, each monaural waveform data comprising waveform data of a monaural waveform; a tone generator (111, 112, 113, 116) which includes N (N is an integer equal to or greater than one) tone generating units (time slots), each tone generating unit operates in either a stereo mode or a monaural mode indicated by a mode flag for the tone generating unit, a tone generating unit in the stereo mode reads out waveform data for a left-channel and a right-channel from said waveform memory and generates tone waveforms of the left-channel and the right-channel based on the read-out waveform data, and a tone generating unit in the monaural mode reads out waveform data for one channel from said waveform memory and generates a tone waveform of the one channel based on the read-out waveform data; registers (23) storing control data for the N tone generating units, control data for each tone generating unit including the mode flag, first waveform information, second waveform information, a frequency number and a characteristic parameter; and a controller (122, 10) which sets control data to said registers to control tone generation by said tone generator, wherein said controller (122, 10) being adapted to, in response to a tone generation command instructing generation of a new tone: (i) assign (S11-S15) one of the tone generating units to generate the new tone instructed by the tone generation command; (ii) determine (S16) whether the new tone instructed to be generated by the tone generation command is stereo or monaural; (iii-a) if the new tone is stereo, generate (S17) control data for the new tone including a mode flag indicative of the stereo mode, first waveform information, second waveform information, a frequency number and a characteristic parameter which are to be used for generation of the new tone, and set the generated control data into said registers, as control data for the assigned one tone generating unit; (iii-b) if the new tone is monaural, generate (S17) control data for the new tone including a mode flag indicative of the monaural mode, first waveform information, a frequency number and a characteristic parameter which are to be used for generation of the new tone, and set the generated control data into said registers, as control data for the assigned one tone generating unit; and (iv) give (S18) to the assigned one tone generating unit a tone generation start instruction, and wherein said tone generator (111, 112, 113, 116) being adapted to, by means of each one tone generating unit in response to the tone generation start instruction given to the one tone generating unit by said controller: (a) if the mode flag for the one tone generating unit stored in said registers is indicative of the stereo mode, (a-i) read out waveform data of a left-channel or right-channel waveform, specified by the first waveform information for the one tone generating unit in said registers, and waveform data of a right-channel or left-channel waveform, specified by the second waveform information for the one tone generating unit in said registers, from said waveform memory at a rate indicated by the frequency number for the one tone generating unit in said registers; (a-ii) control a tone characteristic of the read-out waveform data of the left-channel waveform and a tone characteristic of the read-out waveform data of the right-channel waveform on the basis of the characteristic control parameter of the one tone generating unit in said registers, to thereby generate a tone waveform of the left channel and a tone waveform of the right channel; (b) if the mode flag for the one tone generating unit stored in said registers is indicative of the monaural mode, (b-i) read out monaural waveform data, specified by the first waveform information for the one tone generating unit in said registers, from said waveform memory at the rate indicated by the frequency number for the one tone generating unit in said registers; and (b-ii) control a tone characteristic of the read-out waveform data of the monaural waveform on the basis of the characteristic control parameter for the one tone generating unit in said registers, to thereby generate a monaural tone waveform.

According to the present invention constructed in the aforementioned manner, when a tone generation instruction has been generated, it is only necessary to assign one tone generating unit to the tone generation irrespective of whether the instructed tone generation is monaural tone generation or stereo tone generation. Further, because some data are shared between the left and right channels of the one tone generating unit, the quantity of data to be set into the tone generator register for stereo tone generation can be less than twice the quantity of data to be set into the tone generator register for monaural tone generation. Further, when tone generation is to be started, a tone generation start instruction only has to be given to the assigned tone generating unit after various parameters have been set into the tone generator register, irrespective of whether the instructed tone generation is stereo tone generation or monaural tone generation. Namely, there is no need to take the trouble of performing control to simultaneously place both of the left and right channels in a note-on state even in the case where the instructed tone generation is stereo tone generation. Further, because at least one of the F number and the characteristic control parameter is shared between the left channel and the right channel, the control section only has to change in real time the value of at least one of the F number and characteristic control parameter for one of the two channels of the tone generating unit stored in the tone generator register, rather than changing in real time the two parameter values for both of the two tone generating channels of the tone generating unit, even where the instructed tone generation is stereo tone generation. Although any one of parameters for controlling the above-mentioned pitch envelope waveform (pitch EG waveform), tone volume envelope waveform (tone volume EG waveform), filter envelope waveform (filter EG waveform) and low-frequency waveform (LFO waveform) correspond to the characteristic control parameter, a release start instruction (note-off construction) other than the aforementioned may also correspond to the characteristic control parameter.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIGS. 3A and 3B are diagrams showing data stored in tone generator registers provided in the embodiment of the tone generation apparatus;

FIG. 4 is a diagram showing a data organization or format of waveform data stored in a waveform memory provided in the embodiment of the tone generation apparatus;

DETAILED DESCRIPTION

Figure 1:
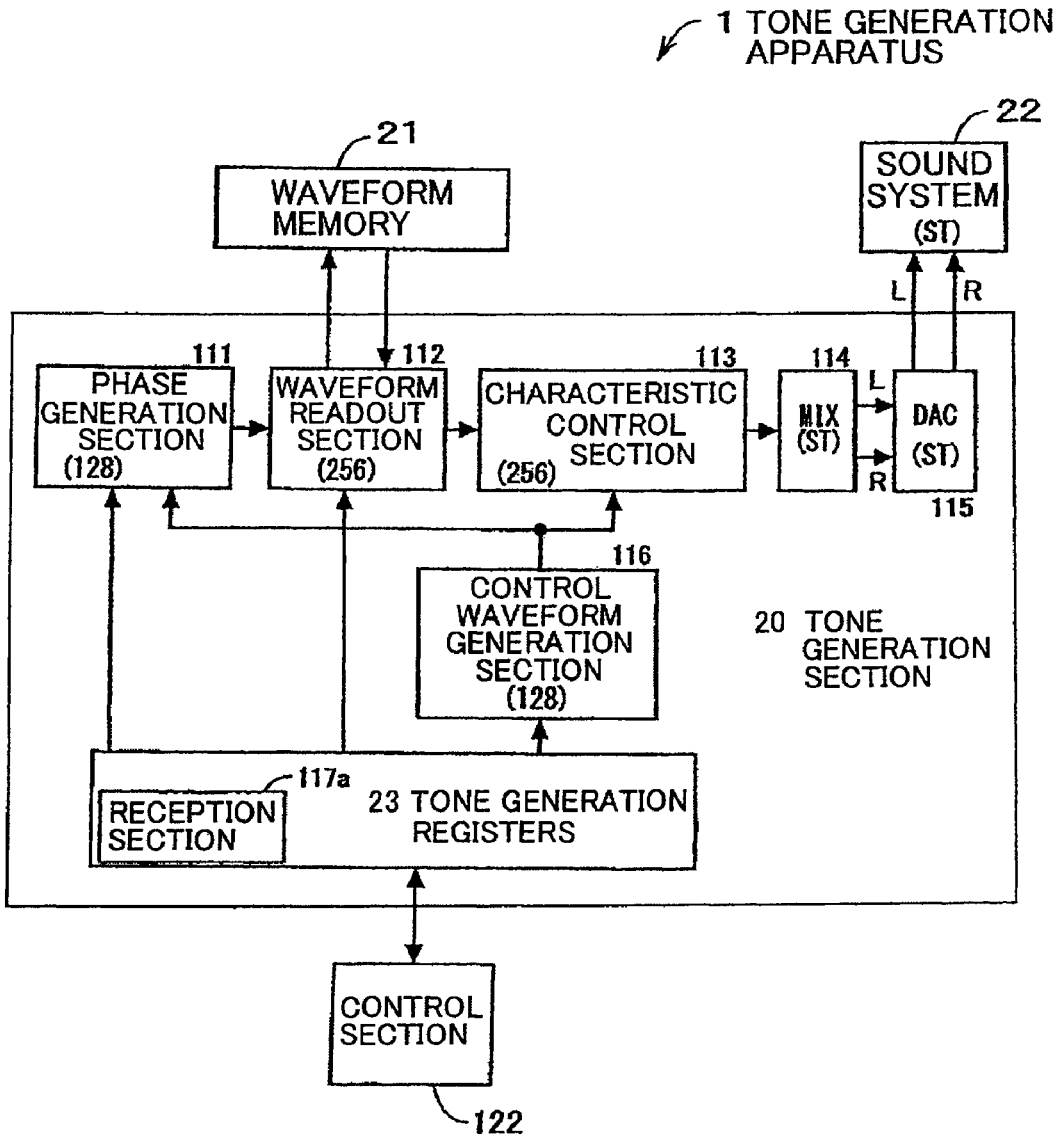
FIG. 1 is a block diagram showing an example general construction of an embodiment of a tone generation apparatus of the present invention.

FIG. 1 is a block diagram showing an example construction of an embodiment of a tone generation apparatus of the present invention. In the tone generation apparatus 1 shown in FIG. 1, which is implemented by tone generating integrated circuitry, a tone generator section 20 includes N (which is an integer equal to or greater than one) tone generating units each comprising two stereo tone generating channels, i.e. left channel and right channel. For example, if the number of tone generating channels provided in the tone generator section 20 is 256, then the number of the tone generating units is 128 that is half the number of tone generating channels. Further, in order to simultaneously generate a plurality of tones, the tone generation apparatus 1 is constructed to perform tone generation processing in a plurality of the tone generating units on a time-divisional basis per sampling period. Further, because tone waveform samples of two channels are arithmetically generated on a time-divisional basis in each of the tone generating units, tone waveform samples twice the number of the tone generating units are arithmetically generated per sampling period. Further, in the tone generation apparatus 1, some of parameters are shared between the left and right channels constituting the tone generating unit. Namely, type-1 parameters are channel-specific parameters that are to be used individually in each of the left and right channels and that are stored independently for each of the left and right channels in tone-generating unit storage regions provided in the tone generator registers 23. Further, type-2 parameters are parameters that are to be shared between the left and right channels and that are stored in the tone-generating unit storage regions in association with both of the left and right channels, i.e. for shared use between the left and right channels. Namely, the tone generator registers 23 includes the tone-generating unit storage regions for storing N (integer equal to or greater than one) tone color control data corresponding to the N tone generating units. Each of the tone color control data includes: left-channel and right-channel waveform designating information each of which is a type-1 parameters to be used for the tone color in question and which are indicative of waveform data of stereo left and right channels, respectively; an F (frequency) number which is a type-2 parameter and which determines a tone pitch common to both of the left and right channels; and a characteristic control parameter which is also a type-2 parameter.

A waveform memory 21 of the tone generation apparatus 1 has prestored therein a plurality of pairs of stereo-sampled left-channel and right-channel waveform data (i.e., left-channel and right-channel waveform data pairs). Such a left-channel and right-channel waveform data pair is prestored for each of various tone colors and for each of various pitch ranges. However, for tone colors unsuited for stereo tone generation, monaurally-sampled, monaural waveform data are prestored in the waveform memory 21.

FIG. 4 shows an example data organization or format (memory map) of a multiplicity of waveform data prestored in the waveform memory 21. In the data format shown in FIG. 4, waveform data WD1*m* is monaural waveform data, and waveform data WD2*sl* and WD2*sr* are a stereo waveform data pair, of which the waveform data WD2*sl* is left-channel waveform data while the waveform data WD2*sr* is right-channel waveform data. Similarly, waveform data WD3*sl* and WD3*sr* are a stereo waveform data pair, of which the waveform data WD3*sl* is left-channel waveform data while the waveform data WD3*sr* is right-channel waveform data. A multiplicity of such monaural waveform data and a multiplicity of such stereo waveform data are stored in the waveform memory 21. Each of the left-channel and right-channel waveform data is not different in nature from monaural waveform data. Thus, only any one of the left-channel and right-channel waveform data can be read out as monaural waveform data, as desired.

Further, a phase generation section 111 of FIG. 1 generates progressive phases for individual ones of the plurality of tone generating units on a time-divisional basis, at which time, per tone generating unit, the phase generation section 111 generates a progressive phase common to the left and right channels of the tone generating unit by accumulating an F number (frequency number=pitch information) of the tone generating unit stored in the tone generator registers 23. The F number accumulation in each of the tone generating units is triggered or started in response to a tone generation start instruction given to the tone generating unit by a control section 122 via a reception section 117*a*. Note that, for each of the tone generating units, the reception section 117*a* receives a tone generation start instruction independently of the other tone generating units.

Further, for each of the tone generating units, a waveform readout section 112 reads out, from the waveform memory 21, left-channel waveform data on the basis of the phase of the tone generating unit supplied from the phase generation section 111 and left-channel waveform designating information of the tone generating unit stored in the tone generator section 23 and right-channel waveform data on the basis of the phase of the tone generating unit supplied from the phase generation section 111 and right-channel waveform designating information of the tone generating unit stored in the tone generator section 23. Such readout of left-channel and right-channel waveform data by the waveform readout section 112 is performed on a time-divisional basis for the individual tone generating units.

Furthermore, for each of the tone generating units, a control waveform generation section 116 generates a characteristic control waveform, common to both of the left and right channels and varying in value over time, on the basis of control waveform parameters of the tone generating unit stored in the tone generator section 23. The characteristic control waveform generated by the control waveform generation section 116 is supplied to a characteristic control section 113, and the characteristic control section 113 controls tone characteristics of the left-channel and right-channel waveform data on the basis of the supplied characteristic control waveform so that tone signals of the left and right channels of the tone generating unit are formed. Such characteristic control waveform generation and tone signal formation is performed on a time-divisional basis for the individual tone generating units. Examples of the characteristic control waveform generated by the control waveform generation section 116 include a pitch envelope waveform (pitch EG waveform) for controlling pitch variation of a tone, tone volume envelope waveform (tone volume EG waveform) for controlling volume variation of a tone, filter envelope waveform (filter EG waveform) for controlling frequency characteristic variation of a tone, and low-frequency waveform (LFO waveform) for imparting low-frequency modulation to a pitch and volume of a tone. Further, the tone signal can be imparted with a vibrato by the LFO waveform generated by the control waveform generation section 116 being supplied to the phase generation section 111, and the tone signal can be imparted with a wah-wah or tremolo effect by the LFO waveform being supplied to the characteristic control section 113.

Once the control section 122 receives a tone generation command (note-on instruction) instructing generation of a new tone by receiving performance information from any of a MIDI (Musical Instrument Digital Interface), keyboard, sequencer, etc., the control section 122 performs a process for assigning any one of the N tone generating units to the instructed generation of the new tone at later-described steps S11 to S15, irrespective of whether the instructed generation is stereo tone generation or monaural tone generation. Then, the control section 122 forms tone color control data, including left-channel and right-channel waveform designating information, F number and characteristic control parameter, for use in the instructed generation of the new tone, and sets (stores) the generated tone color control data into the storage region, corresponding to the assigned tone generating unit, of the tone generator registers 23, at later-described steps S16 and S17. Then, the control section 122 instructs the reception section 117*a* to start tone generation of the assigned tone generating unit, at later-described step S18. If the instructed tone generation is stereo tone generation, the two channels of the tone generating unit is instructed to start the tone generation. Thus, the phase generation section 111 starts accumulation of the F number of the tone generating unit, in response to the tone generation start instruction of the tone generating unit received via the reception section 117*a*, to generate a progressive phase common to both of the left and right channels of the tone generating unit. Then, the waveform readout section 112, which is supplied with the thus-generated progressive phase, reads out one left-channel waveform data from the waveform memory 21 on the basis of the phase of the tone generating unit supplied from the phase generation section 111 and left-channel waveform designating information of the tone generating unit stored in the tone generator registers 23, and reads out one right-channel waveform data from the waveform memory 21 on the basis of the phase of the tone generating unit supplied from the phase generation section 111 and right-channel waveform designating information of the tone generating unit stored in the tone generator registers 23. Each of the read-out one left-channel waveform data and the read-out one right-channel waveform data has a tone pitch shifted from a fundamental pitch (later-described) of the respective waveform data in accordance with the F number stored in the tone generator registers 23.

The left-channel waveform data and right-channel waveform data read out from the waveform readout section 112 are controlled on the basis of the characteristic control waveform, generated by the control waveform generation section 116 and varying over time during tone generation, so that respective tone waveform samples of the left channel and right channel of the tone generating unit are formed. Then, the left-channel tone waveform samples and right-channel tone waveform samples of the individual tone generating units are output time-divisionally from the characteristic control section 113 to left-channel and right-channel portions, respectively, of an accumulation (MIX) section 114 of a stereo construction, in which the left-channel tone waveform samples of the tone generating units allocated within one sampling period and output to the left-channel portion are accumulated while the right-channel tone waveform samples of the tone generating units allocated within the one sampling period and output to the right-channel portion are accumulated. Thus, the left-channel tone waveform sample and the right-channel tone waveform sample accumulated across all of the tone generating units are output from the MIX section 114 to a DAC (Digital-to-Analog Converter) 115 of a stereo construction per DAC period (i.e., conversion period of the DAC 115) that is identical to one sampling period. In the stereo-constructed DAC 115, the accumulated left-channel tone waveform sample and right-channel tone waveform sample are converted into analog left-channel and right-channel tone signals, respectively. Consequently, stereo tone signals are audibly generated or sounded from a sound system (amplifiers and speakers) 22 of a stereo construction.

Figure 2:
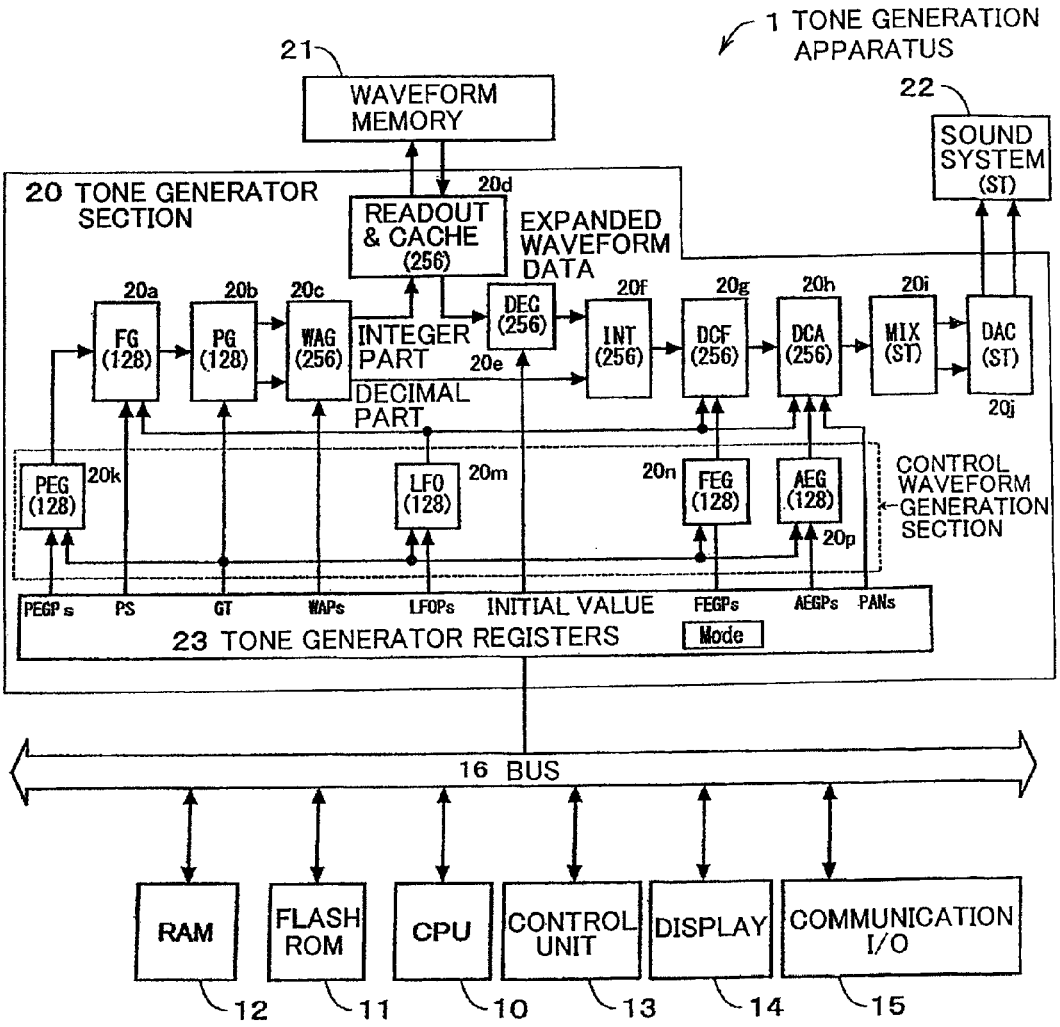
FIG. 2 is a block diagram showing an example detailed construction of the tone generation apparatus shown in FIG. 1.

Respective numbers of processing slots (i.e., time slots of time divisional processing) that are required for stereo tone generation in the phase generation section 111, waveform readout section 112, control waveform generation section 116 and characteristic control section 113 in the tone generation apparatus 1, where the number of tone generating channels is set at 256 and the number of the tone generating units is set at 128, are indicated in the corresponding blocks by parenthesized numerals in FIGS. 1 and 2. Namely, for the phase generation section 111 which generates a progressive phase common to both of the two channels of each of the tone generating units, the number of the processing slots required for the phase generation is 128. For the waveform readout section 112 which reads out, from the waveform memory 21, waveform data for the two channels of each of the tone generating units, the number of the processing slots required for the waveform data readout is 256. Further, for the control waveform generation section 116 which generates a control waveform common to both of the two channels of each of the tone generating units, the number of the processing slots required for the control waveform generation is 128. For the characteristic control section 113 which controls tone characteristics of waveform data for the two channels of each of the tone generating units, the number of the processing slots required for the tone characteristic control is 256.

Note that, once monaural tone generation is instructed to any one of the tone generating units, the waveform readout section 112 reads out one monaural waveform data from the waveform memory 21 on the basis of the left-channel waveform designating information or right-channel waveform designating information. Namely, the waveform readout section 112 reads out, from the waveform memory 21, waveform data of only one of the two channels of the tone generating unit. Tone characteristics of the monaural waveform data read out by the waveform readout section 112 are controlled in the characteristic control section 113 in accordance with a characteristic control waveform, generated by the control waveform generation section 116 and varying over time during tone generation, so that a monaural tone waveform sample is output to the left-channel and right-channel portions of the MIX section 114. As noted above, the MIX section 114, DAC 115 and sound system 22 are each constructed in a stereo manner, and the characteristic control section 113 outputs the same monaural tone waveform sample from one of the channels of the tone generating unit to the left-channel and right-channel portions of the MIX section 114 with a tone volume based on a panning parameter. The tone waveform sample thus output to the left-channel and right-channel portions of the MIX section 114 is accumulated with tone waveform samples of the other tone generating units output to the left-channel and right-channel portions of the MIX section 114, and the resultant accumulated tone wave samples are output from the left-channel and right-channel portions of the MIX section 114 to the DAC 115. The accumulated tone wave samples of the left and right channels are then converted, per DAC period, by the DAC 115 of the stereo construction into analog tone signals of the left and right channels that are sounded or audibly generated via the sound system 22 of the stereo construction. In this case, stereo signals for stereo tone generations and monaural signals for monaural tone generation are audibly generated in a mixed fashion from the sound system 22.

In the instant embodiment of the tone generation apparatus 1, as set forth above, two tone signals, i.e. left-channel and right-channel tone signals, are formed on the basis of a phase signal common to the left and right channels per tone generating unit, and thus, the number of progressive phases to be generated by the phase generation section 111 is equal to the number of the tone generating units that is half the number of simultaneously generatable tones. In this way, it is possible to reduce the amount of processing and thus reduce the scale of the circuitry. Because precise pitch control is generally required for tone generation and the phase generation section 111 generates a progressive phase of a bit length exceeding 20 bits, the scale of the circuitry tends to increase. Further, because the control waveform generation section 116 generates a control waveform common to the left and right channels per tone generating unit on the basis of characteristic control parameter of the tone generating unit, the number of control waveforms to be generated by the control waveform generation section 116 is equal to the number of the tone generating units that is half the number of simultaneously generatable tones, and thus, it is possible to reduce an amount of processing to be performed by the control waveform generation section 116 and reduce the scale of the circuitry. Further, because the channel assignment to tone generation is performed on the tone generating units (i.e., on a tone-generating-unit-by-tone-generating-unit basis) that are half the number of the tone generating channels, the instant embodiment can reduce the processing load on the control section 122 even in a case where truncate processing is performed. In the channel assignment to tone generation, the processing load amount would increase exponentially depending on the number of tone generating channels or tone generating units to be assigned. Further, because the F number and characteristic control parameter are also shared between the two channels in each of the tone generating units and the same F number and characteristic control parameter only have to be set per tone generating unit, the instant embodiment can reduce the time necessary for the control section 122 to set the characteristic control parameters into the tone generator registers 23 and thus reduce the size or scale of the tone generator registers 23.

Further, in the instant embodiment of the tone generation apparatus 1, which is capable of executing both stereo tone generation and monaural tone generation, it is only necessary to assign one tone generating unit in response to a tone generation instruction irrespective of whether the instructed tone generation is stereo tone generation or monaural tone generation. Further, for each tone generating unit via which stereo tone generation is to be performed, the waveform readout section 112 reads out, from the waveform memory 21, left-channel waveform data and right-channel waveform data at a rate corresponding to the same F number, and a predetermined characteristic of the read-out left-channel and right-channel waveform data is controlled by the characteristic control section 113 in accordance with the same characteristic control parameter (or characteristic control waveform based on the characteristic control parameter) so that a left-channel tone signal and a right-channel tone signal having been controlled in tone pitch and tone characteristic similarly to each other are formed. In this case, because the left-channel tone signal and the right-channel tone signal are formed on the basis of the same or common phase signal, the number of progressive phases to be generated by the phase generation section 111 is equal to the number of the tone generating units that is half the number of the tone generating channels, and thus, it is possible to reduce the amount of processing and thus reduce the scale of the circuitry. Further, because the control waveform generation section 116 generates a control waveform common to the left and right channels on the basis of the same characteristic control parameter per tone generating unit, the number of control waveforms generated to be by the control waveform generation section 116 is equal to the number of the tone generating units that is half the number of simultaneously generatable tones, and thus, it is possible to reduce the amount of processing to be performed by the control waveform generation section 116 and reduce the scale of the circuitry. Note that the characteristic control waveform to be generated by the control waveform generation section 116 is any one of the pitch envelope waveform (pitch EG waveform), volume envelope waveform (tone volume EG waveform), filter envelope waveform (filter EG waveform) and low-frequency waveform (LFO waveform).

Because the F number and the characteristic control parameter are shared between the left channel and the right channel as noted above, the quantity of data to be set into the tone generator registers 23 for stereo tone generation can be less than twice the quantity of data to be set into the tone generator registers 23 for monaural tone generation. Thus, the setting time required of the control section 122 can be significantly reduced. Further, after various parameters have been set into the tone generator registers 23, it is only necessary that a tone generation start instruction be given to the assigned tone generating unit, irrespective of whether the instructed tone generation is stereo tone generation or monaural tone generation; namely, there is no need to take the trouble of performing control to simultaneously place both of the left and right channels in a note-on state even in the case where the instructed tone generation is stereo tone generation. Further, because the F number and the characteristic control parameter are shared between the left channel and the right channel as noted above, the control section 122 only has to change in real time the value of the F number and the characteristic control parameter of the tone generating unit in question stored in the tone generator registers 23, rather than changing in real time two parameter values of the two tone generating channels of the tone generating unit, even where the instructed tone generation is stereo tone generation, and thus, the instant embodiment can reduce the amount of processing to be performed by the control section 122.

The instant embodiment of the tone generation apparatus 1 of the present invention shown in FIG. 1 is implemented by the tone generating integrated circuitry. Because the processing amounts of some of the components (blocks) can be reduced as noted above, it is possible to minimize the size or scale of an integrated circuit of the tone generator section 20 that generates tones, even where the number of the tone generating channels is increased.

FIG. 2 is a block diagram showing an example detailed construction of the tone generation apparatus 1 shown in FIG. 1. The tone generation apparatus 1 shown in FIG. 2 performs the same tone generating processing and achieves the same behavior and advantageous benefits as the tone generation apparatus 1 shown in FIG. 1, and blocks indicated by the same reference numerals as in FIG. 1 represent generally the same functions as those shown in FIG. 1.

In the tone generation apparatus 1 shown in FIG. 2, the tone generator section 20 includes N (which is an integer equal to or greater than one) tone generating units each consisting of left and right channels for executing stereo tone generation, as noted above in relation to FIG. 1. For example, if the number of the tone generating channels provided in the tone generator section 20 is 256, then the number of the tone generating units is set at 128 that is half the number of the tone generating channels. Further, in order to simultaneously generate a plurality of tones, the tone generation apparatus 1 is constructed to perform tone generation processing in the individual tone generating units on a time-divisional basis per sampling period. Further, because tone waveform samples are arithmetically generated in individual ones of the two channels in each one of the tone generating units, tone waveform samples that are twice the number of the tone generating units are arithmetically generated per sampling period.

In the tone generation apparatus 1 shown in FIG. 2, a CPU (Central Processing Unit) 10 is the control section which executes various programs, pertaining to tone generation, to control various functions and processing including tone generation processing in the tone generation apparatus 1. A flash ROM (Read-Only Memory) 11 is a rewritable non-volatile memory which stores therein a tone generation processing program for execution by the CPU 10 and various data, such as tone color data. A RAM (Random Access Memory) 12 is a volatile main memory in the tone generation apparatus 1, and a working area for use by the CPU 10 and other storage regions are set in the RAM 12. A control unit 13 is a performance control unit, such as a keyboard, and including various switches, and a user can give various instructions to the tone generation apparatus 1 by operating the various switches. Further, a display device 14 displays various information at the time of tone generation. A communication I/O 15 is an interface capable of inputting or receiving performance information etc. from external equipment, and this communication I/O 15 is, for example, in the form of a MIDI interface for transmitting and receiving MIDI messages to and from external equipment. Under control of the CPU 10, the tone generator section 20 reads out, from the waveform memory 20, waveform data necessary for tone generation, performs processing, such as interpolation, envelope impartment and channel accumulation (mixing), on the read-out waveform data, and output the thus-processed waveform data as analog tone waveform signals. In the illustrated example of FIG. 2, two arrows are depicted from an accumulation section (MIX) **20*i* to the sound system 22, so as to clearly show that two data of a stereo format pass from the accumulation section (MIX) 20*i* to the sound system 22. The remaining one arrow indicates that a plurality of signals pass on a time-divisional basis, rather than indicating that only one data passes. For example, 128 data, corresponding to the 128 tone generating units, are supplied on a time-divisional basis, from an F number generator (FG) 20*a* to a phase generator (PG) 20*b*. Tone waveform signals output from the tone generator section 20 are supplied to the sound system 22 so that stereo tones will be sounded or audibly generated through the sound system 22. Note that various components including the above-mentioned are interconnected via a bus 16**.

In the tone generator registers 23 of the tone generator 20 are set 128 tone color control data corresponding to the 128 tone generating units. The tone color control data are each formed by the CPU 10 performing processing responsive to a note-on instruction (tone generation instruction) and set into respective regions provided in the tone generator registers 23 in corresponding relation to the tone generating units. The tone color control data thus set into the regions of the tone generator registers 23 include data pertaining to the individual tone generating units (i.e., "tone-generating-unit-specific data") as shown in FIG. 3A, and data pertaining to the left channel and right channels of the tone generating units (i.e., 256 tone generating channels) (i.e., "tone-generating-channel-specific data") as shown in FIG. 3B.

The tone-generating-unit-specific data shown in FIG. 3A comprises: pitch shift data (PS) represented in a cent value; LFO parameters (LFOPs) including an LFO frequency, PM depth, FM depth and AM depth; PEG parameters (PEGPs) including PEG rates and PEG levels of individual states; FEG parameters (FEGPs) including FEG rates and FEG levels of individual states; AEG parameters (AEGPs) including AEG rates and AEG levels of individual states; panning data (PANs) including left-channel panning data (PAN(L)) and right-channel panning data (PAN(R)); and a mode flag (Mode) indicative of any one of a stereo tone generation mode and monaural tone generation mode. The above-mentioned pitch shift data (PS) is data for controlling an amount by which waveform data read out from the waveform memory is to be shifted in tone pitch, and it is an F number in a cent scale. While the F number generator (FG) **20*a* generates an F number in a linear scale of frequency ratios as will be described later, the pitch shift data (PS) is a principal factor that determines a value of the F number to be generated by the F number generator (FG) 20*a***. The pitch shift data (PS) has a resolution of one cent, and an interpolator is provided for smoothing variation of the value of the F number in such a manner that there occurs no noise even when the value of the F number is changed in real time. Of the above-mentioned parameters, each parameter with a lower-case "s" attached at the end of an upper-case acronym of the parameter indicates that the parameter is not a single parameter and comprises a plurality of parameters.

Further, the tone-generating-channel-specific data, pertaining to the left or right channel of a tone generating unit, shown in FIG. 3B comprises: waveform address parameters (WAPs) including a start address (WS) that is waveform designating information of the channel in question, loop start address (LS) and end address (WE); compression information for controlling decompression of waveform data if the waveform data is in compressed form; and other parameters including loop information for controlling loop readout. In the monaural tone generation mode, monaural waveform data is designated by left-channel waveform designating information; right-channel waveform designating information is not used in the monaural tone generation mode.

The above-mentioned three addresses WS, LS and WE are absolute addresses of the waveform memory in the illustrated example. Alternatively, only any one of the three addresses WS, LS and WE may be made an absolute address of the waveform memory with the remaining two addresses made relative addresses to the absolute address. For example, the loop start address LS may be made an absolute address with the start address WS and end address WE made relative addresses to the loop start address LS. In such a case, the two relative addresses may be made common to both of the two channels of the tone generating unit in question and included in the tone-generating-unit-specific data of FIG. 3A. Namely, the waveform designating information employed in the present invention corresponds to at least one of the three addresses WS, LS and WE which is an absolute address of the waveform memory.

Furthermore, the tone generator registers 23 include, in addition to the regions corresponding to the tone generating units as shown in FIGS. 3A and 3B, a region of a tone generation start flag GT (GU) instructing a start of tone generation to each of the tone generating units GU and a region of a release start flag RT (GU) instructing a start of release to each of the tone generating units GU.

Figure 5A:
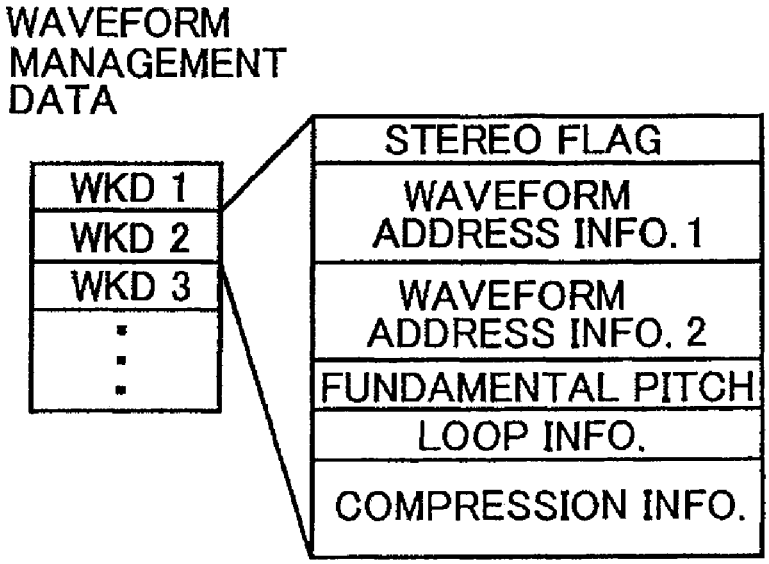
FIGS. 5A and 5B are diagrams showing data formats of waveform management data and tone color data stored in a flash memory provided in the embodiment of the tone generation apparatus.
Figure 5B:
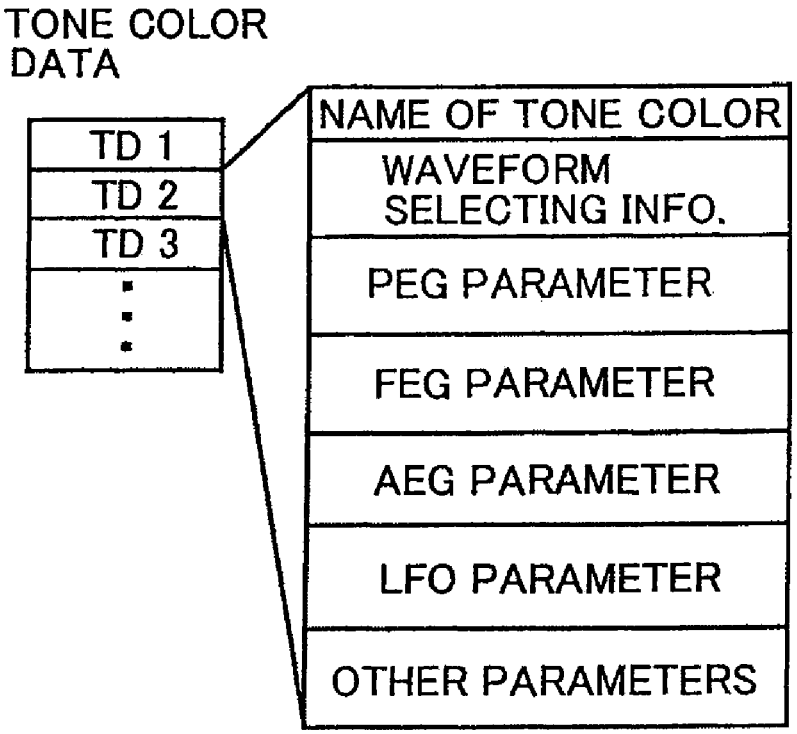

The flash ROM 11 has stored therein a plurality of waveform management data for managing the plurality of waveform data recoded in the waveform memory 21, and a plurality of tone color data that are parameters of a plurality of tone colors selectable in the tone generation apparatus 1. The instant embodiment of the tone generation apparatus 1 is a multi-part tone generator, which, for each of the parts, can select a tone color from among the plurality of tone colors and set the selected tone color as a tone color of that part. Then, in the tone generation apparatus 1, tones are generated, in accordance with performance information of the individual parts, with respective tone colors set for the parts. FIG. 5A shows a data organization or format of the waveform management data, and FIG. 5B shows a data organization or format of the tone color data. In waveform data readout from the waveform memory 21, any one of the waveform data is selected by reference to tone color data of a tone color set in a tone generator part, and the selected waveform data is read out from the waveform memory using the management data corresponding to the selected waveform data.

The waveform management data shown in FIG. 5A are data necessary for reading out waveform data from the waveform memory 21, and each of the waveform management data corresponds to a stereo waveform data pair or monaural waveform data stored in the waveform memory 21. "WKD1" represents waveform management data corresponding to monaural waveform data WD1*m*, "WKD2" represents waveform management data corresponding to a stereo waveform data pair comprising waveform data WD2*sl* and waveform data WD2*sr*. Further, "WKD3" represents waveform management data corresponding to a stereo waveform data pair comprising waveform data WD3*sl* and waveform data WD3*sr*. Each of the waveform management data has a similar data format irrespective of whether the corresponding waveform data is a stereo waveform data pair or monaural waveform data, and it includes a stereo flag, first waveform address information ("waveform address information 1"), second waveform address information ("waveform address information 2"), fundamental pitch, loop information and compression information, as specifically shown in relation to the waveform management data WKD2. The stereo flag set at a value "1" indicates that the corresponding waveform data is a stereo waveform data pair, while the stereo flag set at a value "0" indicates that the corresponding waveform data is monaural waveform data. When waveform data for which the stereo flag is set at the value "1" has been selected for new tone generation, the mode flag indicative of the stereo tone generation mode is set into the tone generator region corresponding to a tone generating unit assigned to that tone generation, while, when waveform data for which the stereo flag is set at the value "0" has been selected for new tone generation, the mode flag indicative of the monaural tone generation mode is set into the tone generator register region corresponding to the tone generating unit assigned to that tone generation.

The above-mentioned first waveform address information ("waveform address information 1") indicates a stored position of monaural waveform data in the waveform memory 21 in the case where the stereo flag is at the "0", but indicates a stored position of left-channel waveform data in the waveform memory 21 in the case where the stereo flag is at the "1". The first waveform address information includes information of a start address, loop start address and end address of the monaural waveform data or left-channel waveform data. The second waveform address information ("waveform address information 2") is non-used information in the case where the stereo flag is set at the "0", but information indicative of a stored position of the right-channel waveform data in the case where the stereo flag is set at the "1". The second waveform address information comprises information of a start address, loop start address and end address of right-channel waveform data. The above-mentioned fundamental pitch is information indicative of a pitch of the waveform data when read out with no pitch shift (i.e., F number=1). The loop information comprises information indicative of whether or not loop readout is to be performed, information for correcting a pitch of a loop section for adjusting a pitch of the start of a loop waveform to a pitch of the end of an attack waveform, etc. Further, the compression information comprises information indicative of whether or not the waveform data is in compressed form, compression scheme information indicative of a data compressed scheme used if the waveform data is in compressed form, and compression coefficient information for canceling compression of a leading frame. At the start of tone generation of the tone generating unit, the CPU 10 sets these information into the region, corresponding to or allocated to the tone generating unit, of the tone generator registers 23. A waveform address generator 20*c*, readout & cache section 20*d*, decoder 20*e*, etc. are controlled on the thus-set information.

Further, as shown in FIG. 5B, a plurality of tone color data TD1, TD2, TD3, . . . of a plurality of tone colors are stored in the flash ROM 11. As specifically shown in relation to the tone color data TD2, each of the tone color data includes: a name of the tone color, waveform selecting information; PEG parameter, FEG parameter, AEG parameter and LFO parameter common to the left and right channels; and other parameters.

The above-mentioned waveform selecting information is information for selecting waveform data (more specifically, waveform management information for reading out the waveform data) to be used for generating a tone corresponding to a tone generation instruction in accordance with a tone pitch (note number) and performance intensity (velocity) accompanying the tone generation instruction. For example, in response to a note-on instruction generated by depression of a key of a keyboard provided as the control unit 13, waveform selecting information of tone color data of a tone color set for the keyboard part is referenced in accordance with the note number and velocity accompanying the note-on instruction, so that waveform management data corresponding to one stereo waveform data pair or monaural waveform data is selected.

The above-mentioned PEG parameter, FEG parameter and AEG parameter are parameters for controlling a pitch EG waveform, filter EG waveform and tone volume EG waveform, respectively, each having a broken-line shape having a plurality of states, and each of the PEG parameter, FEG parameter and AEG parameter includes parameters of rates and levels of the individual states and parameters for adjusting the rate and level of one or some of the states in accordance with the note number and velocity. The plurality of states of the tone volume EG waveform, for example, comprise five states, i.e. attack (or hold), first decay, second decay, sustain and release. The attack (or hold) is increased or decreased in level in accordance with the velocity. The LFO parameter comprises information of an LFO frequency for controlling a frequency of an LFO waveform to be generated, a PM depth for controlling an amplitude of the LFO waveform to modulate a pitch of a tone (pitch modulation depth), an FM depth for controlling the amplitude of the LFO waveform to modulate a frequency characteristic of the tone (filter modulation depth) and an AM depth for controlling the amplitude of the LFO waveform to modulate an amplitude of the tone (amplitude modulation depth).

Figure 6:
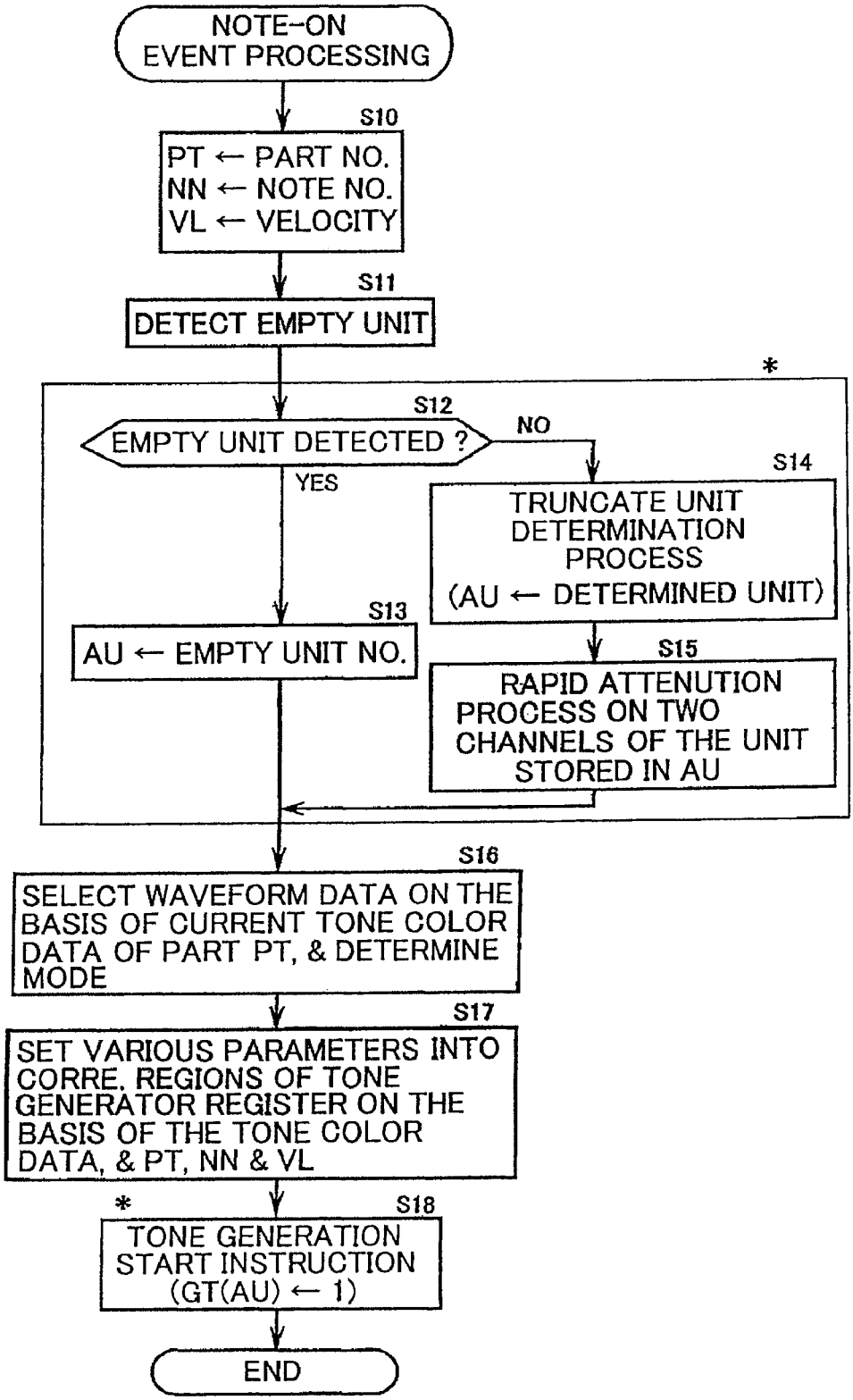
FIG. 6 is a flow chart showing an example operational sequence of note-on event processing performed in the embodiment of the tone generation apparatus.

Once a new note-on instruction instructing a start of generation of a tone is detected in the tone generation apparatus 1, the CPU 10 performs note-on event processing as flowcharted in FIG. 6. In the note-on event processing, the CPU 10 first performs a tone generation assignment process for assigning an tone generating unit to generate a new tone corresponding to the note-on and sets tone color control data, comprising various parameters of the new note-on, into the region, allocated to the tone generating unit, of the tone generator registers 23 (see FIGS. 3A and 3B). Then, in response to the CPU 10 setting the tone generation start flag GT of the tone generating unit, the tone generator section 20 starts tone generation, corresponding to the new note-on, in the assigned tone generating unit, using the tone color control data set in the allocated region. If the mode flag is indicative of the stereo tone generation mode at that time, then stereo tone signals are generated from the tone generator section 20 and output to the sound system 22, while, if the mode flag is indicative of the monaural tone generation mode at that time, then a monaural tone signal is generated from the tone generator section 20 and output to the sound system 22.

The following describe the note-on event processing in greater detail. "Note-on" is an instruction (MIDI message) that instructs a start of generation of a new tone, and such a note-on has, as parameters, a part number indicating of which part the note-on is an instruction (i.e., to which part the note-on instruction is directed), a note number indicative of a pitch of the tone to be generated, and a velocity indicative of an intensity of the tone. For example, once any one of the keys is depressed on the keyboard provided as the control unit 13, a note-on message is generated which includes a part number indicative of a part controlled by the keyboard, a note number of the depressed key and a velocity indicative of a depressing velocity of the key. In an automatic performance of music piece data of a plurality of parts, note-on messages of the individual parts are generated. In some cases, a note-on message is received from external equipment via the communication I/O 15.

Once any one of such note-on messages is detected, the CPU 10 starts the note-on event processing shown in FIG. 6. First, the CPU 10 takes out the part number, note number and velocity from the note-on message generated at step S10 and stores the part number, note number and velocity into regions PT, NN and VL, respectively, secured in the working area of the RAM 12. Next, a detection operation is performed, at step S11, for detecting, from among all of the tone generating units, an empty tone generating unit currently not assigned to tone generation, and a determination is made, at step S12, as to whether or not any empty tone generating unit has been detected in the detection operation. Note that the empty tone generating unit means a free unit which is not assigned to generate any tone currently. If any empty tone generating unit has been detected as determined at step S12, the CPU 10 proceeds to step S13, where it stores a unit number of the detected empty tone generating unit into a region AU secured in the working area of the RAM 12. If, on the other hand, no empty tone generating unit has been detected as determined at step S12, the CPU 10 branches to step S14, where it performs a truncate unit determination process to store the unit number of a determined truncate tone generating unit into the above-mentioned region AU.

More specifically, in the truncate unit determination process, the CPU 10 determines, from among all of the parts, an object-of-search part, such as a part having a low priority for tone generation, through which a truncate tone generating unit is to be searched. The RAM 12 includes the regions for recording part numbers, note numbers etc. of tones being sounded in the individual tone generating units, and the CPU 10 detects tone generating units currently generating tones in the determined part, by referencing information recorded in the regions of the RAM 12. Then, the CPU 10 detects, from among the detected tone generating units, a particular tone generating unit of which a sum between levels of an amplitude of left-channel waveform data and a tone volume EG waveform is the smallest of tone volume levels of two-channel tones currently audibly generated in the detected tone generating units. This is because a tone is generated in the left channel of each of the tone generating units in the monaural tone generation mode. The CPU 10 stores the unit number of the determined truncate tone generating unit into the region AU, after which the truncate unit determination process is brought to an end.

Upon termination of the truncate unit determination process at step S14, the CPU 10 performs a rapid attenuation process (dump process) at step S15 on tones of the left and right channels being generated in the tone generating unit of the unit number stored in the region AU. So far, one tone generating unit has been assigned to generation of the new tone, and the number of the assigned tone generating unit has been stored in the region AU. Upon termination of the operation of step S13 or S15, the CPU 10 proceeds to step S16, where waveform data is selected in accordance with the waveform selecting information of the tone color data (FIG. 5B) of the tone color currently set in the part indicated by the part number of the region PT. Then, the CPU 10 references the stereo flag of the waveform management data (FIG. 5A) corresponding to the selected waveform data, so that, if the waveform data is a stereo waveform data pair, the CPU 10 determines the stereo tone generation mode as the tone generation mode while, if the waveform data is monaural waveform data, the CPU 10 determines the monaural tone generation mode as the tone generation mode.

Then, at step S17, the CPU 10 determines values of various parameters (tone color control data) to be used for generation of the new tone, on the basis of the above-mentioned tone color data and the part number, note number and velocity stored in the regions PT, NN and VL. Then, the CPU 10 set the determined parameters into storage regions (FIGS. 3A and 3B), corresponding to the unit number stored in the region AU, of the tone generator registers 23. The various parameters set by the CPU 10 are tone color control data including, among others: the mode flag indicative of the determined tone generation mode; left-channel and right-channel waveform designating information of the waveform data selected in accordance with the waveform selecting information in the tone color data of the current tone color, the note number and the velocity value; loop information; compression information; LFO parameters, PEG parameters, FEG parameters and AEG parameters included in the tone color data of the current tone common to the left and right channels and processed in accordance with the note number and velocity value; pitch shift data (F number in the cent scale) based on a difference between the above-mentioned note number and the fundamental pitch; and panning data. Note, however, that the right-channel waveform designating information has to be set only in the stereo tone generation mode and need not be set in the monaural tone generation mode (because, in the monaural tone generation mode, the right-channel waveform designating information has no information to be set). After having set the tone color data into the region AU at step S17, the CPU 10 goes to step S18, where the CPU 10 writes a value "1" into the tone generation start flag GT(AU) of the tone generator registers 23 to thereby give a tone generation start instruction to the tone generating unit indicated by the unit number stored in the region AU. In this manner, the note-on event processing is brought to an end, and the tone generator 20 starts, in the assigned tone generating unit, generation of tones of the left and right channels (stereo tone generation mode) or generation of a tone of a monaural channel (monaural tone generation mode) in response to the tone generation start instruction (GT(AU)←1) and on the basis of the set tone color data.

The instant embodiment is characterized in that, irrespective of whether the instructed tone generation is in the stereo tone generation mode or in the monaural tone generation mode, substantively the same operations are performed in the tone generation assignment process of steps S12 to S15 and the tone generation start process of step S18 that are indicated by "*"; namely, the tone generation assignment process and tone generation start process are substantively the same between the stereo tone generation mode and the monaural tone generation mode.

The following describe behavior of various components of the tone generator section 20 in a time slot of the tone generating unit for which the mode flag is set at the value indicative of the stereo tone generation mode (i.e., the tone generating unit set in the stereo tone generation mode), when a tone is to be generated in the tone generating unit.

In the time slot of the tone generating unit, the F number generator (FG) 20*a* is supplied with modulation data (LFO waveform adjusted in amplitude with a PM depth) from an LFO 20*m*, pitch shift data (PS) from the tone generator registers 23 and a pitch EG waveform from a pitch envelope generator (PEG) 20*k*. In the F number generator (FG) 20*a*, the supplied three data are added together and converted from the cent scale to the linear scale, so that an F number common to the left and right channels of the tone generating unit is generated. In this case, the above-mentioned three data are each data represented in a cent value, and the pitch shift data (PS) supplied directly from the tone generator registers 23 is data indicating, in a cent value, a difference between a tone pitch (fundamental pitch shown in FIG. 5A) at which waveform data to be read out from the waveform memory 21 was originally recorded and a pitch (note number) of a tone to be generated. The F number generated by the F number generator 20*a* is linear-value data whose rough value is determined by the pitch shift data and subjected to relatively small adjustment based on the modulation data and pitch EG waveform. When a tone is to be generated at the same pitch as the pitch at which the waveform data was originally recorded, for example, the pitch shift data (PS) is set at "0", and the F number to be generated by the F number generator 20*a* in this case is set at "1", if data supplied as adjusting values from the LFO 20*m* and PEG 20*k* are ignored. The F number generated by the F number generator 20*a* is supplied to the phase generator (PG) 20*b*. Then, in the time slot of the tone generating unit in question, the phase generator (PG) 20*b* accumulates an F number supplied per sampling period and outputs a resultant accumulated value to a waveform address generator (WAG) 20*c*. More specifically, the upper bits of the accumulated value output from the phase generator (PG) 20*b* to the waveform address generator (WAG) 20*c* constitute an integral part of a phase that is common to the left and right channels of the tone generating unit and that is designed to create a read address, while the lower bits of the accumulated value constitute a decimal part of the phase. The F number accumulation in the phase generator 20*b* is started with zero ("0") as an initial value in response to a tone generation instruction (GT) given to the tone generating unit via the reception section of the tone generator registers 23. The integral part of the phase generated is data designating a position of a sample of the waveform data, while the decimal part is data designating a middle point between two adjoining samples of the waveform data.

Further, in the slot of the tone generating unit in question, PEG parameters (PEGPs), comprising a PEG rate and PEG level of each state and common to the left and right channels, are supplied from the tone generator registers 23 to the PEG 20*k*. On the basis of the PEG parameters, the PEG 20*k* generates a pitch EG waveform which has a plurality of states, which is common to the left and right channels of the tone generating unit and which varies in value every sampling period, and the thus-generated pitch EG waveform is supplied to the FG 20*a*. The generation of the pitch EG waveform is triggered or started in response to the tone generation instruction (GT) of the tone generating unit supplied from the tone generator registers 23. By the pitch EG waveform being supplied to the F number generator (FG) 20*a*, the rate of data readout from the waveform memory 21 is modulated as appropriate in accordance with the pitch EG waveform, and a pitch modulation effect is imparted to an attack pitch etc.

Furthermore, in the slot of the tone generating unit in question, waveform address parameters (WAPs), comprising left-channel waveform designating information including a start address, loop start address and end address of left-channel waveform data, right-channel waveform designating information including a start address, loop start address and end address of right-channel waveform data and loop information, are supplied from the tone generator registers 23 to the waveform address generator (WAG) 20*c*. Then, the waveform address generator (WAG) 20*c* generates waveform addresses for the left and right channels of the tone generating unit on the basis of the waveform address parameters (WAPs) and the integral part of the phase. In each of the channels of the tone generating unit for which has been set loop information indicating that loop readout is not to be performed, a waveform addresses is generated which advances, at the same rate as a sampling-period-by-sampling-period incrementing rate of the integral part of the phase, from a sample position indicated by the start address to a sample position indicated by the end address. In each of the channels of the tone generating unit for which has been set loop information indicating that loop readout is to be performed, on the other hand, a waveform address is generated which first advances, at the same rate as the sampling-period-by-sampling-period incrementing rate of the integral part of the phase, from a sample position indicated by the start address to a sample position indicated by the end address and then repetitively advances from a sample position indicated by the loop start address to the sample position indicated by the end address. The waveform address (integral part) of the phase of the left and right channels is supplied to a readout & cache section 20*d*, while the decimal part of the phase of the left and right channels is supplied to an inter-sample interpolation section (INT) 20*f*. The waveform memory 21 has recorded therein compressed waveform data and non-compressed, i.e. linear, waveform data, and, in the time slots of the left and right channels of the tone generating unit in question, the readout & cache section 20*d* reads out samples of respective waveform data of the left and right channels. If the read-out waveform data of the left and right channels are compressed waveform data, they are expanded by a decoder (DEC) 20*e* in the time slots of the left and right channels of the tone generating unit in question, so that original left-channel waveform data samples and original right-channel waveform data samples are output from the decoder (DEC) 20*e*. If, on the other hand, the read-out waveform data of the left and right channels are linear waveform data, they pass through the decoder (DEC) 20*e* in the time slots of the left and right channels to be output from the decoder (DEC) 20*e* as left-channel waveform data samples and right-channel waveform data samples.

The following describe the compressed waveform data recorded in the waveform memory 21. Waveform data comprising successive samples is segmented into a plurality of frames, and a length-variable compression process is performed on the waveform data on a frame-by-frame basis. The compressed waveform data of each of the frame is stored at a predetermined number j of successive addresses of the waveform memory 21 where data of n bits can be stored at each address. At each of the j successive addresses, k samples of the compressed waveform data, the number of bits of which is fixed constant within the frame, are stored successively at m bits of the n bits, while auxiliary information including the compression information is stored at the remaining, i.e. (n−m), bits. Thus, when the compressed waveform data is to be read out from the waveform memory 21, the readout & cache section 20*d*, in each of the time slots of the left and right channels of the tone generating unit in question, generates a memory address that increments or advances by one as the waveform address supplied from the waveform address generator (WAG) 20*c* advances by k per sampling period, accesses the waveform memory 21 with the generated memory address to read out the data of the n bits, and takes out the data of the (n−m) bits from the read-out data of the n bits to thereby output the auxiliary information including the compression information. Further, the readout & cache section 20*d* takes out the data of the m bits from the read-out data of the n bits and temporarily stores the read-out data of the m bits into a cache memory. Then, in the time slots of the left and right channels of the tone generating unit in question, the decoder (DEC) 20*e* accesses the cache memory with the waveform address to sequentially read out the k samples of the compressed waveform data, and performs an expansion process on the sequentially-read-out samples of the compressed waveform data, on the basis of the compression information, to thereby restore original waveform data.

The compression information to be used to expand the compressed waveform data is compression information previously stored in the frame read out immediately before the current read-out frame. Thus, at an initial stage where there is no such compression information, the compressed waveform data is expanded using initial decoder values supplied from the tone generator registers 23. See Japanese Patent No. 3912304 for details of the compressed waveform data.

Latest two samples of the waveform data of each of the left and right channels, output from the decoder (DEC) 20*e* without being converted from the linear data form or after having been expanded, are supplied to the inter-sample interpolation section (INT) 20*f* in a corresponding one of the time slots of the left and right channels of the tone generating unit. In each of the time slots of the left and right channels of the tone generating unit, the inter-sample interpolation section (INT) 20*f* performs an interpolation process on the two samples of the left or right channel on the basis of the decimal part of the phase of the tone generating unit having been supplied from the waveform address generator (WAG) 20*c*, to thereby provide interpolated waveform data of the left or right channel. Note that, in a case where four-point interpolation is to be performed by the inter-sample interpolation section (INT) 20*f*, latest four samples of each of the left and right channels are supplied from the decoder (DEC) 20*e*, and the inter-sample interpolation section (INT) 20*f* performs an interpolation process on the four samples of each of the left and right channels on the basis of the decimal part of the phase, to thereby provide interpolated waveform data of each of the left and right channels.

The interpolated waveform data of the left and right channels output from the inter-sample interpolation section (INT) 20*f* are supplied to a digital control filter (DCF) 20*g*, where high frequency components of the interpolated waveform data are attenuated. Namely, in the time slots of the left and right channels of the tone generating unit, the digital control filter (DCF) 20*g* is supplied with the modulation data (LFO waveform adjusted in amplitude with an FM depth) from the LFO 20*m* and the filter EG waveform from the filter envelope generator (FEG) 20*n*, and a cutoff frequency and Q (selectivity) of the digital control filter (DCF) 20*g* are controlled in accordance with the two supplied data, so that respective high frequency components of the waveform data of the left and right channels are attenuated. Further, in the time slot of the tone generating unit, the filter envelope generator (FEG) 20*n* is supplied with the FEG parameters (FEGPs), including FEG rates and FEG levels of individual states, which are common to the left and right channels. The filter envelope generator (FEG) 20*n* generates, on the basis of the supplied FEG parameters (FEGPs), a filter EG waveform of a plurality of states, which is common to the left and right channels and whose value varies every sampling period, and the thus-generated filter EG waveform is supplied to the digital control filter (DCF) 20*g*. The filter EG waveform generation is triggered or started in response to a tone generation instruction (GT) supplied from the tone generator registers 23.

The processed waveform data of the left and right channels output from the digital control filter (DCF) 20*g* are supplied to a digital control amplifier (DCA) 20*h*, where respective tone volumes of the waveform data of the left and right channels are controlled. More specifically, in the time slots of the left and right channels of the tone generating unit in question, the digital control amplifier (DCA) 20*h* is supplied with the modulation data (LFO waveform adjusted in amplitude with an AM depth) from the LFO 20*m*, tone volume EG waveform from a tone volume envelope generator (AEG) 20*p* and sound-image localizing panning data (PANs) from the tone generator registers 23. Thus, the tone volume of the left-channel waveform data is controlled in accordance with the modulation data supplied from the LFO 20*m*, tone volume EG waveform and left-channel panning data (PAN(L)), so that the resultant volume-controlled left-channel waveform data is output to the left-channel portion of the MIX 20*i*. Similarly, the tone volume of the right-channel waveform data is controlled in accordance with the modulation data supplied from the LFO 20*m*, tone volume EG waveform and right-channel panning data (PAN(R)), so that the resultant volume-controlled right-channel waveform data is output to the right-channel portion of the MIX 20*i*. In this manner, the left-channel waveform data (i.e., tone data of the left channel) and right-channel waveform data (i.e., tone data of the right channel), which have been subjected to sound image localization in accordance with the panning data (PANs), are output to the left-channel and right-channel portions of the MIX 20*i* in the time slot of the tone generating unit in question. Furthermore, in the time slot of the tone generating unit, the tone volume envelope generator (AEG) 20*p* is supplied with the AEG parameters (AEGPs) including AEG rates and AEG levels of individual states, which are common to the left and right channels, from the tone generator registers 23. Thus, the tone volume envelope generator (AEG) 20*p* generates, on the basis of the supplied AEG parameters (AEGPs), a tone volume EG waveform of a plurality of states which is common to the left and right channels and whose value varies per sampling period, and the thus-generated tone volume envelope generator (AEG) 20*p* is supplied to the digital control amplifier (DCA) 20*h*. The tone volume EG waveform generation is triggered or started in response to a tone generation instruction (GT) supplied from the tone generator registers 23.

Within one DAC period, samples of waveform data are output, in the time slots of the individual tone generating units, to the left-channel and right-channel portions of the MIX 20*i*. Thus, in the time slots of the individual tone generating units within one DAC period, the MIX 20*i* accumulates samples of the waveform data supplied to the left-channel portion and accumulates samples of the waveform data supplied to the right-channel portion, separately between the left channel and the right channel. Then, every DAC period, stereo waveform data comprising left-channel and right-channel samples, which are accumulated results for all of the tone generating units, are output from the MIX 20*i* to a DAC 20*j*. Every DAC period, the DAC 20*j* converts the supplied waveform data into analog stereo waveform signals and supplies the thus-converted analog stereo waveform signals of the left and right channels to the stereo sound system 22, so that the stereo waveform signals are sounded or audibly generated via the sound system 22.

Furthermore, in the time slot of the tone generating unit, the LFO 20*m* is supplied with the LFO parameters (LFOPs) including an LFO frequency, PM depth, FM depth and AM depth, which are common to the left and right channels, from the tone generator registers 23. Thus, the LFO 20*m* generates an LFO waveform, which is common to the left and right channels, of a frequency indicated by the LFO frequency, and the thus-generated LFO waveform is controlled in amplitude in accordance with the PM depth, FM depth and AM depth and then supplied to the FG 20*a*, DCF 20*g* and DCA 20*h*. The LFO waveform generation is triggered or started in response to a tone generation instruction (GT) supplied from the tone generator registers 23. A tone signal can be imparted with a wah-wah effect by the LFO waveform being supplied to the DCF 20*g*, and a tone signal can be imparted with a tremolo by the LFO waveform being supplied to the DCA 20*h*.

As seen from the foregoing, the phase generation section 111 in the construction of FIG. 1 corresponds to the F number generator (FG) 20*a* and phase generator (PG) 20*b*, the waveform readout section 112 corresponds to the waveform address generator (WAG) 20*c*, readout & cache section 20*d*, decoder (DEC) 20*e* and inter-sample interpolation section (INT) 20*f*, the characteristic control section 113 corresponds to the digital control filter (DCF) 20*g* and digital control amplifier (DCA) 20*h*, and the control waveform generation section 116 corresponds to the PEG 20*k*, LFO 20*m*, filter envelope generator (FEG) 20*n* and tone volume envelope generator (AEG) 20*p* which are shown in FIG. 2 as surrounded by a dotted-line rectangular block and which generate control waveforms varying over time during tone generation. Further, the control section 122 correspond to the CPU 10.

The above description about the behavior of the various component of the tone generator section 20 has been given in relation to the case where stereo tones are generated in the time slot of the tone generating unit for which the mode flag indicates the stereo tone generation mode (i.e., tone generating unit set in the stereo tone generation mode). Note that the waveform memory 21 has recorded therein monaural waveform data and a stereo waveform data pair for each of various tone colors and for each of various pitch ranges. Thus, when a tone is to be generated in a given tone generating unit of the tone generation apparatus 1, and if stereo waveform data has been selected as waveform data to be read out from the waveform memory 21, the mode flag indicative of the stereo tone generation mode is set for the tone generating unit, so that stereo tones will be generated in the time slot of the tone generating unit. When a tone is to be generated in a given tone generating unit of the tone generation apparatus 1, and if monaural waveform data has been selected as waveform data to be read out from the waveform memory 21, the mode flag indicative of the monaural tone generation mode is set for the tone generating unit, so that a monaural tone will be generated in the time slot of the tone generating unit. The waveform data to be read out from the waveform memory 21 is waveform data selected in accordance with a set tone color, note number, velocity, etc., and such waveform data is prepared as a stereo waveform data pair or monaural waveform data in view of various factors, such as: a factor as to whether the tone color is one allowing listeners to perceive or recognize a stereo effect; performance frequency of a pitch range and intensity with that tone color; and limitations due to a total capacity of the waveform memory.

The following describe behavior of the various components of the tone generator section 20 in a given tone generating unit, for which the mode flag is set at the value indicative of the monaural tone generation mode.

Once a new note-on event instruction is detected in the tone generation apparatus 1, the CPU 10 performs the tone generation assignment process for assigning an tone generating unit to generate a new tone corresponding to the note-on and sets various parameters of the new note-on, shown in FIGS. 3A and 3B, into the region, allocated to the tone generating unit, in the tone generator registers 23. Although the mode flag is indicative of the monaural tone generation mode and the note-on instructs monaural tone generation in this case, a two-channel tone generating unit is assigned. Whereas the instant embodiment has been described above as executing monaural tone generation by use of various resources of the left channel of the two channels of the individual tone generating units provided in the tone generator section 20, the monaural generation may be performed using various resources of the right channel.

Once various parameters are set into the region, allocated to the tone generating unit assigned to the new note-on, in the tone generator registers 23 and a tone generation start is instructed to the assigned tone generating unit, the F number generator (FG) 20*a* generates an F number in the time slot of the tone generating unit as in the case where stereo tones are to be generated, and the phase generator (PG) 20*b* accumulates the F number per sampling period in the time slot of the tone generating unit and generates a progressive phase, comprising an integral part and decimal part, for generating a read address to thereby output the generated phase to the waveform address generator 20C as in the case where stereo tones are to be generated.

The waveform address generator (WAG) 20C, in the time slot of the left channel of the tone generating unit, generates a waveform address of the left channel of the tone generating unit on the basis of the left-channel waveform designating information and loop information of the waveform address parameters (WAPs) and the integral part of the phase. The waveform address (integral part) of the left channel output from the waveform address generator (WAG) 20C is supplied to the readout & cache section 20*d*, so that samples of monaural waveform data are read out from the waveform memory 21. The thus-read-out monaural waveform data is supplied to the decoder 20*e*, where it is expanded in the time slot of the left channel of the tone generating unit so that samples of original monaural waveform data are output from the decoder 20*e*. Latest two samples of the monaural waveform data, output from the decoder (DEC) 20*e*, are supplied to the inter-sample interpolation section (INT) 20*f*. In the time slot of the left channel of the tone generating unit, the inter-sample interpolation section (INT) 20*f* performs an interpolation process on the two samples on the basis of the decimal part of the phase of the tone generating unit having been supplied from the waveform address generator (WAG) 20*c*, to thereby provide interpolated waveform data. The interpolated monaural waveform data of the monaural tone generating unit output from the (INT) 20*f* is supplied to the digital control filter (DCF) 20*g*, where high frequency components of the interpolated waveform data are attenuated, in the time slot of the interpolated waveform data, in accordance with the cutoff frequency and Q (selectivity) corresponding to the modulation data from the LFO 20*m* and filter EG waveform from the filter envelope generator (FEG) 20*n*. Thus, the monaural waveform data having adjusted high frequency components is output. As in the stereo tone generation, the PEG 20*k*, FEG 20*n*, AEG 20*p* and LFO 20*m* generate a pitch EG waveform, filter EG waveform, amplitude EG waveform and LFO waveform in the time slot of the tone generating unit.

The monaural waveform data output from the digital control filter (DCF) 20*g* is supplied to the digital control amplifier (DCA) 20*h*, where the monaural waveform data is controlled in tone volume in the time slots of the left and right channels of the tone generating unit. The digital control amplifier (DCA) 20*h* is supplied with the modulation data from the LFO 20*m*, tone volume EG waveform from the tone volume envelope generator (AEG) 20*p* and panning data (PANs) from the tone generator registers 23. In this case, the monaural waveform data is controlled in tone volume in accordance with the modulation data from the LFO 20*m*, tone volume EG waveform and panning data of the left channel (PAN(L)) and then output to the left-channel portion of the MIX 20*i*, while the monaural waveform data is controlled in tone volume in accordance with the modulation data from the LFO 20*m*, tone volume EG waveform and panning data of the right channel (PAN(R)) and then output to the right-channel portion of the MIX 20*i*. In this manner, the monaural waveform data which have been subjected to sound image localization in accordance with the panning data (PANs) are output, as left-channel and right-channel tone data, to the left-channel and right-channel portions of the MIX 20*i* in the time slot of the tone generating unit in question.

In the MIX 20*i*, the monaural waveform data sample supplied to the left-channel portion of the MIX 20*i* in the time slot of the tone generating unit is accumulated with waveform data samples supplied to the left-channel portion in the time slots of the other tone generating units, while the monaural waveform data sample supplied to the right-channel portion of the MIX 20*i* in the time slot of the tone generating unit is accumulated with waveform data samples supplied to the right-channel portion in the time slots of the other tone generating units. Thus, the waveform data samples of the left and right channels accumulated for all of the tone generating units in one DAC period are output from the MIX 20*i* to the DAC 20*j*. Every DAC period, the DAC 20*j* converts the supplied waveform data samples into analog stereo waveform signals and supplies the thus-converted analog stereo waveform signals of the left and right channels to the sound system 22. Thus, via the sound system 22 are audibly generated or sounded stereo waveform signals that is a mixture of stereo signals of the stereo tone generating units and monaural signals of the monaural tone generating units having been sound-image-localized in accordance with the panning data (PANs).

In the tone generating unit set in the monaural tone generation mode, as set forth above, the waveform address generator 20*c*, readout & cache section 20*d* and decoder 20*e*, each of which has resources available to two (left and right) channels, are used in processing of only one of the two channels, and thus, the resources available to the remaining one channel remain unused. Thus, if arrangements are made such that all of these resources are diverted to readout of monaural waveform data samples per sampling period of the tone generating unit, it is possible to read out and decode twice as many samples per sampling period, and thus, in the monaural tone generation, an upward pitch shift twice as much as an ordinary upward pitch shift can be executed during monaural tone generation.

Figure 7:
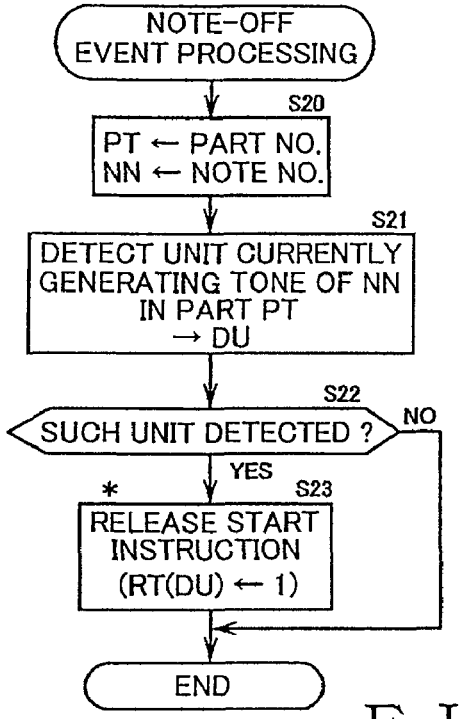
FIG. 7 is a flow chart showing an example operational sequence of note-off event processing performed in the embodiment of the tone generation apparatus.

FIG. 7 is a flow chart showing an example operational sequence of note-off event processing performed by the CPU 10 in response to a note-off instruction instructing a start of attenuation of a tone. The note-off instruction is a MIDI message instructing a start of attenuation of a tone and accompanied by parameters of a part number indicating of which part the note-off is an instruction (i.e, to which part the note-off instruction is directed) and a note number indicative of a pitch of the tone whose attenuation is to be started. For example, once any one of the keys having so far being depressed is released on the keyboard provided as the control unit 13, a note-off message is generated which includes a part number indicative of a part controlled by the keyboard and a note number of the released key. In some cases, a note-off instruction is received from external equipment via the communication interface 15.

Once a note-off instruction is detected, the CPU 10 starts up the note-off event processing shown in FIG. 7. First, at step S20, a part number of a tone for which the note-off has been instructed is stored into the region PT secured in the working area of the RAM 12, and a note number of the tone is stored into the region NN secured in the working area. At next step S21, an operation is performed for detecting, from among all of the tone generating units currently generating tone data in the tone generator section 20, for a particular tone generating unit currently generating the tone of the pitch indicated by the note number of the region NN in the part indicated by the part number of the region PT. Once such a particular tone generating unit is detected, the unit number of the detected tone generating unit is stored into a region DU secured in the working area of the RAM 12. Then, at step S22, the CPU 10 determines whether such a particular tone generating unit currently generating the tone of the pitch indicated by the note number of the region NN in the part indicated by the part number of the region PT has been detected. If it has been determined that such a particular tone generating unit has been detected, the CPU 10 proceeds to step S23. At step S23, the CPU 10 writes a value "1" into an attenuation start flag RT (DU) to thereby issue a release start instruction to the tone generating unit indicated by the unit number stored in the region DU. In this manner, the note-off event processing is brought to an end, so that the pitch envelope generator (PEG) 20*k*, filter envelope generator (FEG) 20*n* and tone volume envelope generator (AEG) 20*p* of the tone generator section 20 shift, in response to the release start instruction (RT (DU)←1), all of the pitch EG waveform, filter EG waveform and amplitude EG waveform, currently being generated in the time slot of the tone generating unit in question, to a release state. The amplitude EG waveform having been shifted to the release state gradually decreases from the current level toward a zero level (−∞) at a release-state AEG rate supplied from the tone generator registers 23, so that tone data of the left and right channels currently being generated in the time slots of the left and right channels gradually attenuate in tone volume toward the zero level. If the tone generating unit currently generating the tone of the pitch, indicated by the note number of the region NN in the part indicated by the part number of the region PT, has not been detected as determined at step S22, the CPU 10 terminates the note-off event processing without performing any other operations. Further, if any tone generating unit having attenuated sufficiently has been detected, the CPU 10 performs a release operation for releasing the detected tone generating unit as the above-mentioned "empty tone generating unit".

Note that the instant embodiment is characterized in that the attenuation start instruction operation performed at step S23 (indicated by mark "*") is substantively the same between the stereo tone generation mode and the monaural tone generation mode.

Figure 8:
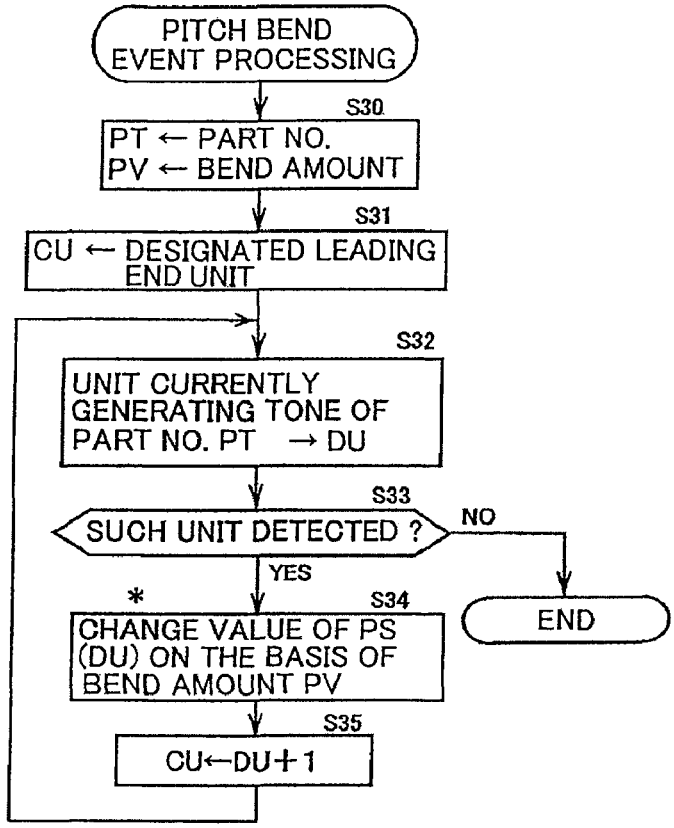
FIG. 8 is a flow chart showing an example operational sequence of pitch bend processing performed in the embodiment of the tone generation apparatus.

FIG. 8 is a flow chart of pitch bend processing performed by the CPU 10 in response to detection, during generation of a tone, of a pitch bend command. The pitch bend command is a command (MIDI message) that causes pitches of one or more tones, which are being generated in one part, to vary in real time, and the pitch bend instruction is accompanied by parameters of a part number indicating to which one of the parts the pitch bend command has been directed and a bend amount indicative of a pitch change amount. For example, once a pitch bend wheel provided as the performance control unit 13 is operated, a part number indicative of a part controlled by the pitch bend wheel and a pitch bend command containing a bend amount corresponding to an amount of the operation are generated. In some cases, a pitch bend command is received from external equipment via the communication interface 15.

Once such a pitch bend command is detected, the pitch bend processing of FIG. 8 is started. First, at step S30, the part number and bend amount accompanying the pitch bend command are stored into the regions PT and PV, respectively, secured in the working area of the RAM 12. Then, at step S31, the first or leading-end tone generating unit of the 128 tone generating units is designated, and the unit number of the designated tone generating unit is stored into a region CU. Then, at step S32, the CPU 10 performs an operation for detecting, from among the tone generating units, a particular tone generating unit currently forming tone data of the part number stored in the region PT, starting with the unit number stored in the region Cu, i.e. in a direction from the tone generating unit of the unit number stored in the region CU toward the last or trailing-end tone generating unit. If such a tone generating unit currently forming tone data of the part number stored in the region PT has been detected, the unit number of the detected tone generating unit is stored into the region DU secured in the working area of the RAM 12. Then, a determination is made, at step S33, as to whether the tone generating unit currently forming tone data of the part number stored in the region PT has been detected, and, with an affirmative (YES) determination at step S33, the CPU 10 moves on to step S34.

At step S34, a value of a pitch shift PS(DU), common to the left and right channels of the tone generating unit indicated by the unit number stored in the region DU of the tone generator registers 23, is changed on the basis of the note number of the tone being generated in the tone generating unit and the bend amount stored in the region PV. Upon completion of the operation of step S34, the CPU 10 goes to step S35 to increment the unit number stored in the region DU by one and stores the incremented unit number into the region CU, after which it reverts to step S32. At step S32, the CPU 10 further performs the operation for detecting, from among the tone generating units, a particular tone generating unit currently forming the tone data of the part number stored in the region PT, starting with the tone generating unit of the incremented-by-one unit number stored in the region CU. If such a tone generating unit currently forming the tone data of the part number stored in the region PT has been detected, the unit number of the detected tone generating unit is stored into the region DU, and then operations at and after step S33 are performed. By the operations at step S32 through to step S35 being repetitively performed, all of the tone generating units which are currently forming the tone data of the part number stored in the region PT are detected, and the value of the pitch shift PS(DU), common to the left and right channels of each of the detected tone generating units, is changed on the basis of the bend amount stored in the region PV. When all of the tone generating units currently forming the tone data of the part number stored in the region PT have been detected and it has been determined at step S33 that there is no more tone generating unit currently forming the tone data of the part number stored in the region PT, the pitch bend event processing is brought to an end. As a result of the aforementioned pitch bend event processing, the pitches of all of the tone data of the part number indicated by the pitch bend command vary (bend) in accordance with the bend amount indicated by the pitch bend command.

Note that the instant embodiment is characterized in that the pitch change operation performed at step S34 (indicated by a mark "*") is substantively the same between the stereo tone generation mode and the monaural tone generation mode.

As set forth above, the note-on event processing, note-off event processing and pitch bend event processing is performed on a tone generating unit generating tone data to be controlled, irrespective of where the tone data to be controlled is to be generated monaurally or stereophonically. The monaural tone generation seemingly appears to involve a lot of waste because a portion of the resources of the tone generating unit remains unused. But, in view of the current tendency that tone colors using high-quality stereo tone are increasing, the resources are not wasted so much as a matter of fact, and thus, the advantage of reducing the load on the CPU 10 is far greater than the disadvantage of the wasted resources.

Further, in the above-described embodiment of the tone generator apparatus, either the stereo tone generation mode or the monaural tone generation mode is set individually for each of the tone generating units. With this arrangement, the tone generating unit set in the stereo tone generation mode and the tone generating unit set in the monaural tone generation mode are allowed to generate tone data in a parallel fashion.

Whereas the embodiment of the tone generation apparatus of the present invention has been described above in relation to the case where the waveform memory has recorded therein compressed waveform data as well, the present invention is not so limited, and the waveform memory may have recorded therein only non-compressed waveform data. In such a case, the decoder 20*e* that performs the waveform expansion process may be dispensed with. Further, whereas the embodiment of the tone generation apparatus of the present invention has been described above in relation to the case where the number of the tone generating channels employed in the tone generation apparatus is 256, the present invention is not so limited, and the number of the tone generating channels may be more or less than 256. In either case, it is essential that the number of the tone generating units be half the number of the tone generating channels.

Furthermore, in the above-described embodiment, each of the components (blocks) having resources available to stereo two channels, such as the waveform address generator (WAG) 20*c*, readout & cache section 20*d*, decoder (DEC) 20*e*, inter-sample interpolation section (INT) 20*f*, digital control filter (DCF) 20*g*, etc., is constructed to perform processing on monaural waveform data by use of the left-channel resources in the time slot of the tone generating unit set in the monaural tone generation mode. However, each of the aforementioned components (blocks) having resources available to stereo two channels may be modified to perform processing on monaural waveform data by use of the right-channel resources.

Furthermore, the truncate unit determination process performed in the embodiment of the tone generation apparatus has been described as determining a to-be-truncated tone generating unit on the basis of the tone volume level of the left channel of the tone generating unit currently generating a tone of an object-of-search part. Alternatively, a to-be-truncated tone generating unit may be determined on the basis of the tone volume level of any one of the left and right channels which is greater than the tone volume level of the other of the left and right channels. Further, the truncate unit determination process performed in the embodiment has been described as determining a to-be-truncated tone generating unit irrespective of whether the tone generating unit in question is at a stage before the start of a release or at a stage after the start of a release. Alternatively, a tone generating unit where a release has already started may be determined as a to-be-truncated tone generating unit with a higher priority. Furthermore, whereas the embodiment of the tone generator apparatus has been described as first narrowing down the search to a particular part and then determining a to-be-truncated tone generating unit on the basis of a tone volume level of a tone generating unit currently generating a tone of the particular part, such an operation of narrowing down the search may be dispensed with, and a to-be-truncated tone generating unit may be determined on the basis of tone volume levels of tone generating units currently generating tones of all of the parts.

Whereas the CPU 10 in the above-described embodiment is constructed to set pitch shift data (PS), which is an F number represented in the cent scale, into the tone generator registers 23, the CPU 10 may be constructed to set an F number, represented in the linear scale, into the tone generator registers 23. In such a case, there is no need for the F number generator 20*a* to convert the F number, set by the CPU 10, from the cent scale to the linear scale. However, because the construction employed in the F number generator 20*a* for synthesizing the F number from the CPU 10, pitch EG from the pitch envelope generator (PEG) 20*k* and modulation data from the LFO 20*m* would be complicated, storing the F number represented in the linear scale is not suitable from the viewpoint of the design of the apparatus.

Furthermore, whereas control responsive to a pitch bend command has been described above as an example of control for controlling a value of a control parameter in real time, the real time control performed in the present invention is not so limited. For example, real-time control may be performed in response to an expression command for controlling a tone volume in real time, a modulation depth command for controlling in real time a depth of modulation, by an LFO, of an amplitude or the like, a parameter change command for controlling a cutoff frequency in real time, and/or the like.

This application is based on, and claims priorities to, JP PA 2010-174517 filed on 3 Aug. 2010, JP PA 2010-174518 filed on 3 Aug. 2010 and JP PA 2010-174519 filed on 3 Aug. 2010. The disclosure of the priority applications, in its entirety, including the drawings, claims, and the specification thereof, are incorporated herein by reference.

What is claimed is:

1. A tone generation apparatus comprising:

a waveform memory (21) storing a plurality of stereo waveform data, each stereo waveform data comprising waveform data of a left-channel waveform and waveform data of a right-channel waveform;

a tone generator (111, 112, 113, 116) which includes N (N is an integer equal to or greater than one) tone generating units (111, 112, 113, 116), each tone generating unit reads out waveform data for a left-channel and a right-channel from said waveform memory and generates tone waveforms of the left-channel and the right-channel based on the read-out waveform data;

registers (23) storing control data for the N tone generating units, control data for each tone generating unit including left-channel waveform information specifying waveform data of a left-channel waveform in said waveform memory, right-channel waveform information specifying waveform data of a right-channel waveform in said waveform memory, a frequency number for controlling a tone pitch, and a characteristic control parameter for controlling a tone characteristic; and a controller (122, 10) which sets control data to said registers to control tone generation by said tone generator, wherein said controller (122, 10) being adapted to, in response to a tone generation command instructing generation of a new tone:

(i) assign (S11-S15) one of the N tone generating units to generate the new tone instructed by the tone generation command;

(ii) generate (S17) control data for the new tone including left-channel waveform information and right-channel waveform information, a frequency number and a characteristic control parameter which are to be used for the generation of the new tone, and set the generated tone control data into said registers, as control data for the assigned tone generating unit; and (iii) give (S18) to the assigned tone generating unit a tone generation start instruction, and wherein said tone generator (111, 112, 113, 116) being adapted to, by means of each one tone generating unit in response to the tone generation start instruction given to the one tone generating unit by said controller:

(i) read out (111, 112) waveform data of a left-channel waveform and waveform data of a right-channel waveform, specified by the left-channel and right-channel waveform information, respectively, stored in said registers for the one tone generating unit, from said waveform memory at a rate corresponding to the frequency number stored in said registers for the one tone generating unit to thereby shift a tone pitch of the waveform data of the left-channel waveform and a tone pitch of the waveform data of the right-channel waveform in accordance with the frequency number; and (ii) control (113, 116) a tone characteristic of the read-out waveform data of the left-channel waveform and a tone characteristic of the read-out waveform data of the right-channel waveform on the basis of the characteristic control parameter, stored in said registers for the one tone generating unit, to thereby generate a tone waveform of the left channel and a tone waveform of the right channel.

2. The tone generation apparatus as claimed in claim 1, wherein said tone generator includes a phase generator (111, 20*b*) which, for each of the N tone generating units, accumulates the frequency number stored in the registers for the tone generating unit, to thereby generate a progressive phase common to the left-channel and the right-channel in the tone generating unit, and wherein, in response the tone generation start instruction given to one tone generating unit by said controller, said phase generator starts accumulation of the frequency number for the one tone generating unit.

3. The tone generation apparatus as claimed in claim 2, wherein said tone generator further includes a waveform reader (112, 20*c*, 20*d*, 20*f*) which, for each of the N tone generating units, reads out waveform data of a left-channel waveform from said waveform memory on the basis of the progressive phase for the tone generating unit supplied by said phase generator and the left-channel waveform information for the tone generating unit stored in said registers and reads out waveform data of a right-channel waveform from said waveform memory on the basis of the progressive phase for the tone generating unit and the right-channel waveform information for the tone generating unit stored in said registers.

4. The tone generation apparatus as claimed in claim 3, wherein said tone generator further includes a characteristic controller (113, 116, 20*g*, 20*h*, 20*k*, 20*m*, 20*n*, 20*p*) which, for each of the N tone generating units, controls the tone characteristic of the waveform data of the left-channel waveform and the tone characteristic of the waveform of the right-channel waveform read out by said waveform reader, on the basis of the characteristic control parameter for the tone generating unit stored in said tone generator register, to thereby generate respective tone signals of the left channel and the right channel for the tone generating unit.

5. The tone generation apparatus as claimed in claim 1, wherein said characteristic control parameter is a parameter for generating a control waveform, and said tone generator includes a control waveform generator (116, 20*k*, 20*m*, 20*n*, 20*p*) which, for each of the N tone generating units, generates a control waveform common to the left channel and the right channel in the tone generating unit and varying in value over time on the basis of the characteristic control parameter stored in said registers for the tone generating unit, and wherein said tone generator, for each of the N tone generating units, controls the tone characteristic of the waveform of the left-channel waveform and the tone characteristic of the waveform data of the right-channel waveform data on the basis of the control waveform generated for the tone generating unit by said control waveform generator.

6. A tone generation apparatus comprising:

a waveform memory (21) storing a plurality of stereo waveform data, each stereo waveform data comprising waveform data of a left-channel waveform and waveform data of a right-channel waveform and a plurality of monaural waveform data, each monaural waveform data comprising waveform data of a monaural waveform;

a tone generator (111, 112, 113, 116) which includes N (N is an integer equal to or greater than one) tone generating units (time slots), each tone generating unit operates in either a stereo mode or a monaural mode indicated by a mode flag for the tone generating unit, a tone generating unit in the stereo mode reads out waveform data for a left-channel and a right-channel from said waveform memory and generates tone waveforms of the left-channel and the right-channel based on the read-out waveform data, and a tone generating unit in the monaural mode reads out waveform data for one channel from said waveform memory and generates a tone waveform of the one channel based on the read-out waveform data;

registers (23) storing control data for the N tone generating units, control data for each tone generating unit including the mode flag, first waveform information, second waveform information, a frequency number and a characteristic parameter; and a controller (122, 10) which sets control data to said registers to control tone generation by said tone generator, wherein said controller (122, 10) being adapted to, in response to a tone generation command instructing generation of a new tone:

(i) assign (S11-S15) one of the tone generating units to generate the new tone instructed by the tone generation command;

(ii) determine (S16) whether the new tone instructed to be generated by the tone generation command is stereo or monaural;

(iii-a) if the new tone is stereo, generate (S17) control data for the new tone including a mode flag indicative of the stereo mode, first waveform information, second waveform information, a frequency number and a characteristic parameter which are to be used for generation of the new tone, and set the generated control data into said registers, as control data for the assigned one tone generating unit;

(iii-b) if the new tone is monaural, generate (S17) control data for the new tone including a mode flag indicative of the monaural mode, first waveform information, a frequency number and a characteristic parameter which are to be used for generation of the new tone, and set the generated control data into said registers, as control data for the assigned one tone generating unit; and (iv) give (S18) to the assigned one tone generating unit a tone generation start instruction, and wherein said tone generator (111, 112, 113, 116) being adapted to, by means of each one tone generating unit in response to the tone generation start instruction given to the one tone generating unit by said controller:

(a) if the mode flag for the one tone generating unit stored in said registers is indicative of the stereo mode, (a-i) read out waveform data of a left-channel or right-channel waveform, specified by the first waveform information for the one tone generating unit in said registers, and waveform data of a right-channel or left-channel waveform, specified by the second waveform information for the one tone generating unit in said registers, from said waveform memory at a rate indicated by the frequency number for the one tone generating unit in said registers;

(a-ii) control a tone characteristic of the read-out waveform data of the left-channel waveform and a tone characteristic of the read-out waveform data of the right-channel waveform on the basis of the characteristic control parameter of the one tone generating unit in said registers, to thereby generate a tone waveform of the left channel and a tone waveform of the right channel;

(b) if the mode flag for the one tone generating unit stored in said registers is indicative of the monaural mode, (b-i) read out monaural waveform data, specified by the first waveform information for the one tone generating unit in said registers, from said waveform memory at the rate indicated by the frequency number for the one tone generating unit in said registers; and (b-ii) control a tone characteristic of the read-out waveform data of the monaural waveform on the basis of the characteristic control parameter for the one tone generating unit in said registers, to thereby generate a monaural tone waveform.

7. The tone generation apparatus as claimed in claim 6, wherein said controller (122, 10) is further adapted to, in response to a control command designating a value change of a frequency number of a tone being generated:

identify (S31-S33, S35) one tone generating unit, currently generating the tone to be controlled in accordance with the control instruction, from among the N tone generating units; and change (S34) a value of the frequency number for the identified tone generating unit, stored in said registers, into a value designated by the control command, and wherein said tone generator (111, 112, 113, 116) is further adapted to, in response to a change by said controller of the value of the frequency number:

(a) if the mode flag for the identified tone generating unit stored in said registers is indicative of the stereo mode, control a readout rate, at which waveform data of a left-channel waveform and waveform data of a right-channel waveform are being read out from said waveform memory, in accordance with the changed value of the frequency number; and (b) if the mode flag for the identified tone generating unit stored in said registers is indicative of the monaural mode, control a readout rate, at which waveform data of a monaural waveform data is being read out from said waveform memory, in accordance with the changed value of the frequency number.

8. The tone generation apparatus as claimed in claim 6, wherein said controller (122, 10) is further adapted to, in response to a control command designating a value change of a control parameter of a tone being generated:

identify (S31-S33, S35) one tone generating unit, currently generating the tone to be controlled in accordance with the control instruction, from among the N tone generating units; and change (S34) a value of the control parameter for the identified tone generating unit, stored in said registers, into a value designated by the control command, and wherein said tone generator (111, 112, 113, 116) is further adapted to, in response to a change by said controller of the value of the control parameter):

(a) if the mode flag for the identified tone generating unit stored in said registers is indicative of the stereo mode, control a tone characteristic of the read-out waveform data of a left-channel waveform and a tone characteristic of the read-out waveform data of a right-channel waveform in accordance with the changed value of the control parameter; and (b) if the mode flag for the identified tone generating unit stored in said registers is indicative of the monaural mode, control a tone characteristic of the read-out waveform data of a monaural waveform in accordance with the changed value of the control parameter.

* * * * *